US006397755B1

(12) United States Patent
Kamler

(10) Patent No.: US 6,397,755 B1
(45) Date of Patent: Jun. 4, 2002

(54) AMUSEMENT RIDE

(75) Inventor: Frank Kamler, Toronto (CA)

(73) Assignee: Ride Factory Incorporated, Toronto (CA)

( * ) Notice: Subject to any disclaimer, the term of this patent is extended or adjusted under 35 U.S.C. 154(b) by 0 days.

(21) Appl. No.: 09/659,840

(22) Filed: Sep. 11, 2000

(51) Int. Cl.[7] ..... A63G 29/00

(52) U.S. Cl. ..... 104/53; 104/55; 104/63; 104/138.1; 472/43; 472/131

(58) Field of Search ..... 104/138.1, 53, 104/55, 56, 63; 187/277; 472/43, 50, 131, 49, 59, 60

(56) References Cited

U.S. PATENT DOCUMENTS

| | | | | |
|---|---|---|---|---|
| 2,965,375 A | | 12/1960 | Hamilton | 272/7 |
| 3,949,953 A | | 4/1976 | Hopkins | 243/3 |
| 4,192,499 A | * | 3/1980 | Groves, Jr. | 104/55 |
| 4,347,791 A | * | 9/1982 | Mandros | 104/156 |
| 4,487,410 A | | 12/1984 | Sassak | 272/6 |
| 4,997,060 A | | 3/1991 | Sassak | 182/48 |
| 5,193,462 A | | 3/1993 | Marcu | 104/138.1 |
| 5,218,910 A | * | 6/1993 | Mesmer et al. | 104/63 |
| 5,253,590 A | * | 10/1993 | Marusak | 104/138.1 |
| 5,417,615 A | | 5/1995 | Beard | 472/50 |
| 5,433,153 A | * | 7/1995 | Yamada | 104/63 |
| 5,447,211 A | | 9/1995 | Sors | 187/277 |
| 5,583,326 A | | 12/1996 | Sors | 187/277 |
| 5,593,352 A | | 1/1997 | Methfessel et al. | 472/50 |
| 5,597,358 A | | 1/1997 | Marcu | 472/50 |
| 5,632,686 A | | 5/1997 | Checketts | 472/131 |
| 5,704,841 A | | 1/1998 | Checketts | 472/131 |
| 5,753,811 A | | 5/1998 | Consolini | 73/147 |
| 5,893,802 A | | 4/1999 | Bohme | 472/131 |
| 5,984,058 A | | 11/1999 | Danneker | 188/312 |
| 6,001,022 A | | 12/1999 | Spieldiener et al. | 472/131 |
| 6,176,788 B1 | | 1/2001 | Checketts | 472/43 |

OTHER PUBLICATIONS

Creating Microgravity—Drop Towers and Tubes; 5 pages.
Bremen Drop Tower; 8 pages.
Introduction of a microgravity experiment center; 11 pages.

* cited by examiner

*Primary Examiner*—S. Joseph Morano
*Assistant Examiner*—Lars A. Olson
(74) *Attorney, Agent, or Firm*—Ridout & Maybee LLP

(57) ABSTRACT

An amusement ride comprises a hollow launch tube having an inner surface and first and second ends, the first end being open; a passenger vehicle having an outer peripheral surface which forms a substantial seal with the inner surface of the launch tube so as to form a substantially sealed space inside said launch tube from said passenger vehicle to the second end of the launch tube; guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube. Such amusement ride overcomes disadvantages of prior art amusement rides by launching a vehicle from a launch tube and guiding the vehicle along a path extending outwardly of the tube, thereby enhancing safety and design possibilities.

32 Claims, 19 Drawing Sheets

AMUSEMENT RIDE

FIELD OF THE INVENTION

The invention relates to an amusement ride, more particularly an amusement ride in which a vehicle is launched from a tube by pressurized gas and is guided along a predetermined path after it leaves the tube.

BACKGROUND OF THE INVENTION

A number of amusement rides are known which accelerate and decelerate a passenger vehicle along a predetermined path, providing riders with a sensation of "g forces" and/or weightlessness. For example, in the amusement ride known as "Superman The Escape" at Six Flags Magic Mountain, Valencia, Calif., linear synchronous motors (LSMs) are used to accelerate a vehicle along a horizontal stretch of track about 600 feet in length to a velocity of about 100 mph. The vehicle is then directed upward along a vertical stretch of track to a height of about 300 feet, subsequently "free falls" down the vertical track, and decelerates as it re-enters the horizontal stretch of track. While the vehicle is travelling upwardly and downwardly along the vertical stretch of track, riders experience a feeling of weightlessness. The ride "Mr. Freeze" (at the same location) also uses LSMs for accelerating a passenger vehicle along a predetermined path. However, the use of LSMs is relatively costly. Furthermore, the riders experience a propulsive "g force" of only about 1 g, whereas the legal limit is typically about 4 g.

Other examples of amusement rides which propel a passenger vehicle are described in U.S. Pat. Nos. 5,632,686 and 5,704,841 to Checketts which issued on May 27, 1997 and Jan. 6, 1998, respectively; U.S. Pat. No. 5,893,912 to Bohme, which issued on Apr. 13, 1999; and U.S. Pat. No. 6,001,022 to Spieldiener et al. which issued on Dec. 14, 1999. These amusement rides accelerate and decelerate a passenger vehicle using compressed air and a piston and cable/pulley system. One major disadvantage of this type of system is that it produces straight-line motions only, thus limiting ride design possibilities.

The amusement ride described in U.S. Pat. No. 4,498,410 to Sassak, issued on Dec. 11, 1984, raises a passenger vehicle through a vertical tube with a blower and entrains the vehicle in the current of air above the tube. One major disadvantage of this system is that the vehicle can only travel straight up and down a short distance outside of the tube, which limits ride design possibilities and provides riders with a sensation of weightlessness which lasts only a few seconds.

Other type of rides exist in which a sensation of weightlessness is produced by a free fall only. One example of such a ride is described in U.S. Pat. No. 5,597,358 to Marcu which issued on Jan. 28, 1997. In the Marcu amusement ride, a passenger vehicle is sealed to the inside walls of a tube by flexible, expandable gaskets and provided with rollers. The vehicle is raised within the tube by a blower and then released to fall in a free fall mode inside the tube. The vehicle brakes at the bottom of the tube by compressing the air beneath it. This system has the disadvantage that it inherently produces only straight up and down motion. Furthermore, the sensation of weightlessness exists only while the vehicle is in free fall mode, and is therefore of short duration.

Another type of amusement ride which provides riders with a weightless experience is disclosed in U.S. Pat. No. 5,417,615 to Beard, issued on May 23, 1995. The Beard patent describes an air driven amusement ride in which a vehicle is propelled from a launch tube by pressurized air introduced into the tube beneath the vehicle. The vehicle is propelled by the pressurized air out of the tube along a tensioned guide cable which is connected at its upper end to a tower. After the vehicle reaches its maximum height, it is returned to the launch tube under the force of gravity where air is used to brake the vehicle.

Thus, Beard provides a simple type of launch and re-entry amusement ride in which riders experience weightlessness during the upward launch and during the subsequent descent of the vehicle under the force of gravity. However, the amusement ride disclosed by Beard is subject to a number of disadvantages. Firstly, because the cable is tensioned between two points, the vehicle is limited to having a straight guide path. Secondly, the cable must be oriented vertically, otherwise gravity loads would bend the cable and the vehicle would risk interfering with the end of the tube upon re-entry. Thirdly, horizontal loads such as crosswinds may also cause deflection of the cable. Fourthly, a single cable affords no control over rotation of the vehicle about the guide cable. Thus, the passenger vehicle may experience uncontrolled spinning as it travels through its trajectory. Fifthly, the positioning of the guide cable through the center of the passenger vehicle limits the design of the vehicle and makes the use of more than one vehicle impractical.

Therefore, the need exists for an amusement ride capable of providing riders with a "g force" and/or weightless experience while being more economical, safer, and having greater design possibilities than presently used amusement rides of this type.

SUMMARY OF THE INVENTION

The present invention overcomes the disadvantages of the prior art amusement rides described above by providing an amusement ride in which a passenger vehicle is launched by pressurized gas and is guided along the path from inside a tube to outside the tube.

In preferred aspects of the invention, the vehicle can re-enter the tube from which it is launched or enter a second tube, for example under the force of gravity, and be caused to brake by pressurization of air inside the tube.

In one embodiment of the invention, the guidance means comprises self-rigid track means extending from inside the tube to outside the tube. The use of a self-rigid track means to guide the vehicle increases the number of design possibilities for the ride. Specifically, the use of a rigid track allows the vehicle to travel along a number of different paths, and allows the ride to take a number of different forms. Furthermore, the use of a rigid track allows control over spinning of the vehicle along its intended path of travel. Accordingly, the present invention provides an amusement ride in which the track can deviate from a simple vertical path, and also provides embodiments in which the track "twists" in relation to the direction of travel to provide controlled spinning motion of the passenger vehicle.

The present invention also provides an embodiment in which the vehicle is guided in a substantially straight path by two or more tensioned guide cables which guide the vehicle along its outer surface for improved control over its trajectory.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
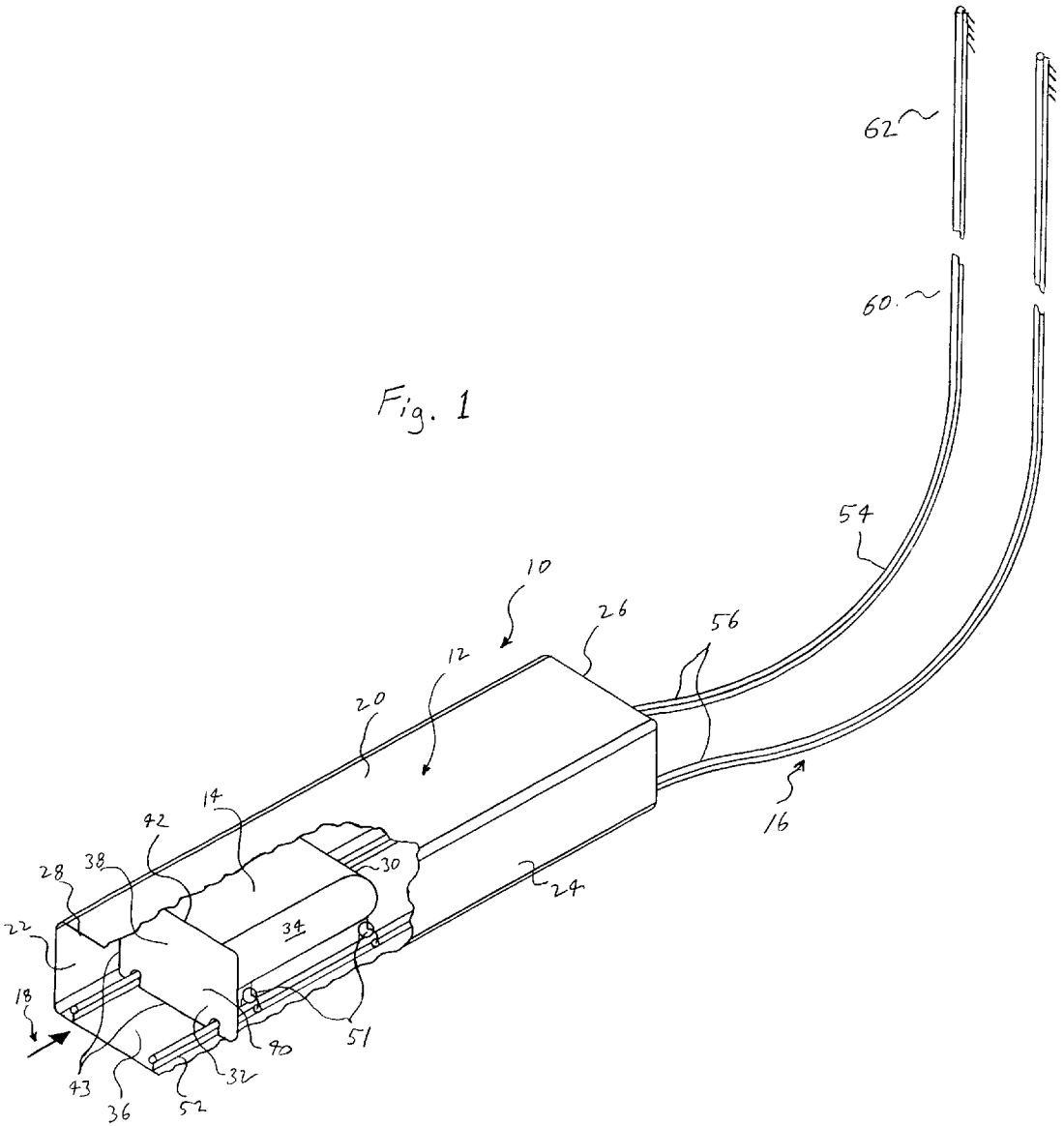
FIG. 1 is a perspective view of an amusement ride according to a first preferred embodiment of the present invention in which a portion of the launch tube has been cut away.

Referring to the accompanying drawings, a launch and re-entry amusement ride 10 according to a first preferred embodiment of the present invention is illustrated in FIG. 1. Amusement ride 10 comprises a hollow launch tube 12, a passenger vehicle 14 located inside tube 12, guidance means comprising a track 16, and a pressurized gas source 18 (not shown except to indicate the direction in which the pressurized gas enters the tube 12) for introducing pressurized gas into the launch tube 12 behind the vehicle 14.

In the embodiment of FIG. 1, the vehicle is propelled out of the launch tube 12 by pressurized gas from the gas source 18, travels along a pre-determined path along track 16, changes direction at the top of its trajectory under the influence of gravity, travels back along the track 16 to the launch tube 12, re-enters the launch tube 12, and is braked by compression of gas inside the launch tube 12. Thus, tube 12 serves as both a launch and re-entry tube in the preferred embodiment of FIG. 1.

The launch tube 12 comprises a side wall 20 having a smooth inner surface 22, an outer surface 24, and first and second ends 26 and 28. The first end 26 of launch tube 12 is open to permit the passenger vehicle 14 to be propelled from and re-enter the tube 12. In the preferred embodiment shown in FIG. 1, the second end 28 of the launch tube 12 is also completely open for communication with the source of pressurized gas 18. However, it will be understood that the second end 28 of launch tube 12 can be provided with a partial end wall through which the launch tube 12 communicates with the source of pressurized gas 18, or a completely closed end wall with the side wall 20 having an opening in communication with the pressurized gas source 18.

The launch tube 12 illustrated in FIG. 1 is oriented substantially horizontally. However, it will be appreciated that the launch tube 12 can have a wide variety of different orientations as described below in conjunction with other preferred embodiments of the present invention. For example, the launch tube 12 may be directed vertically. Furthermore, although the launch tube 12 shown in FIG. 1 is a straight tube of substantially rectangular cross-section with rounded corners, it will be appreciated that the launch tube can be curved and/or may have a variety of cross-sections, including circular. For example, a circular cross-section is preferred in a tower ride where passengers may board and disembark in a radial fashion whereas the rectangular shape may be preferred where passengers board and disembark in a straight through fashion. Other configurations of amusement rides according to the invention are described below in conjunction with the other preferred embodiments.

The passenger vehicle 14 has a front end 30 facing in the direction in which the vehicle is propelled from the launch tube 12, an opposite rear end 32, and a passenger compartment 34 in which riders are protected, and in some cases restrained, for the duration of the ride. The vehicle 14 shown in FIG. 1 comprises a single piece or unit, but may be articulated in the form of a train in embodiments where the track 16 undergoes substantial changes in direction, as in the coaster type ride more completely discussed below. Furthermore, although the vehicle 14 is shown in FIG. 1 as having a closed passenger compartment 34, it will be appreciated that an open vehicle design is feasible where speeds are relatively low.

The vehicle 14 is preferably constructed of lightweight materials to minimize the energy requirements of the pressurized gas source 18. For example, the vehicle 14 may utilize conventional aircraft construction methods in which lightweight aluminum space frames or unibody designs are used. Furthermore, components such as seats, restraints and doors are preferably selected to be lightweight.

The passenger vehicle 14 forms a substantial seal with the inner surface 22 of the launch tube 12 so as to form a substantially sealed space 36 inside the launch tube 12 rearwardly of the rear end 32 of passenger vehicle 14. As used herein, the term "substantially sealed" is intended to mean a degree of sealing sufficient to allow a pressure build-up to be created inside the space 36 to propel the vehicle from the launch tube 12 with a desired tube exit velocity, which is typically the velocity necessary to propel the vehicle along its predetermined path.

In the preferred embodiment of FIG. 1, the passenger vehicle 14 is provided with a pressure wall 38 at its rear end 32, rearwardly of the passenger compartment 34, against which the launching force generated by the pressurized gas source 18 is exerted. The pressure wall has a flat rear surface 40 which is substantially perpendicular to the longitudinal axis of the launch tube 12, the pressure wall 38 being sized and shaped to form a substantial seal with the smooth inner surface 22 of the launch tube 12. It will however be appreciated that the entire pressure wall 38 need not be perpendicular to the longitudinal axis of the launch tube 12, so long as the outer periphery 42 of the pressure wall 38 is substantially perpendicular to the axis of the tube 12. For example, it may be preferred that the vehicle 14 be provided with an aerodynamically shaped fairing which forms part of the pressure wall 38.

In order to form a substantial seal with launch tube 12, it is preferred that the outer periphery 42 of pressure wall 38 either engages or forms a small gap 43 with the inner surface 22 of tube 12. As used herein, a small gap 43 is preferably from about 10 to 20 mm, and more preferably about 15 mm. The provision of a gap 43 is particularly preferred in embodiments such as FIG. 1 in which a track 16 is employed as the guidance means, since it may not be possible to form a complete seal with the track 16.

Figure 2A:
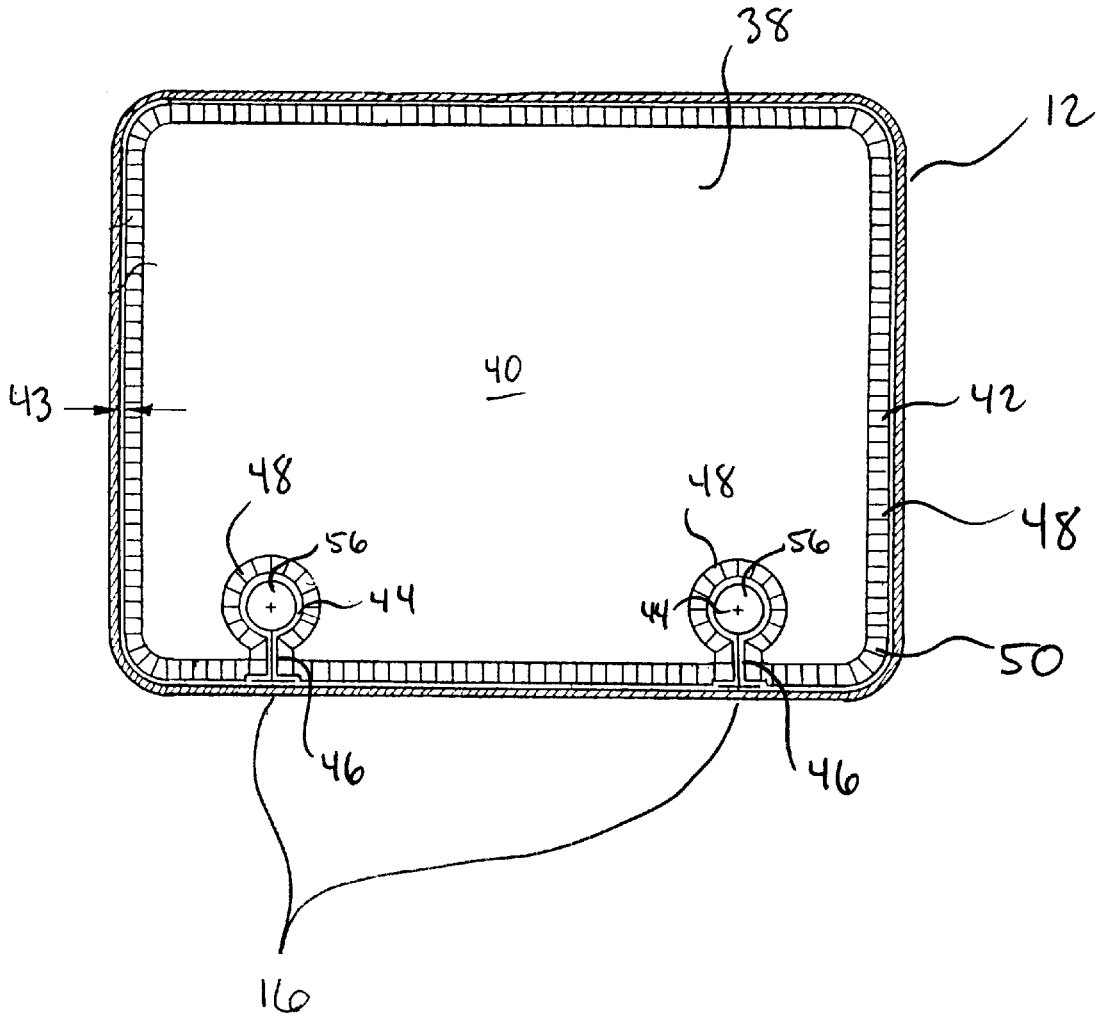
FIGS. 2A and 2B comprise cross-sectional views of an amusement ride according to the first preferred embodiment taken in a plane which is transverse to the launch tube and to the rear of the pressure wall of the passenger vehicle.

FIG. 2A comprises a cross-sectional view through the launch tube 12 of the amusement ride of FIG. 1. The cross-section of FIG. 2A is taken rearwardly of the pressure wall 38 of passenger vehicle 14. As illustrated, a pair of apertures 44 are provided through pressure wall 38 inwardly of its outer periphery 42, apertures 44 including channels 46 extending to the outer periphery of the pressure wall 38. The apertures 44 are shaped to closely receive the track 16, comprising a pair of rails 56 of circular cross-section, with the existence of a small gap therebetween.

Figure 2B:
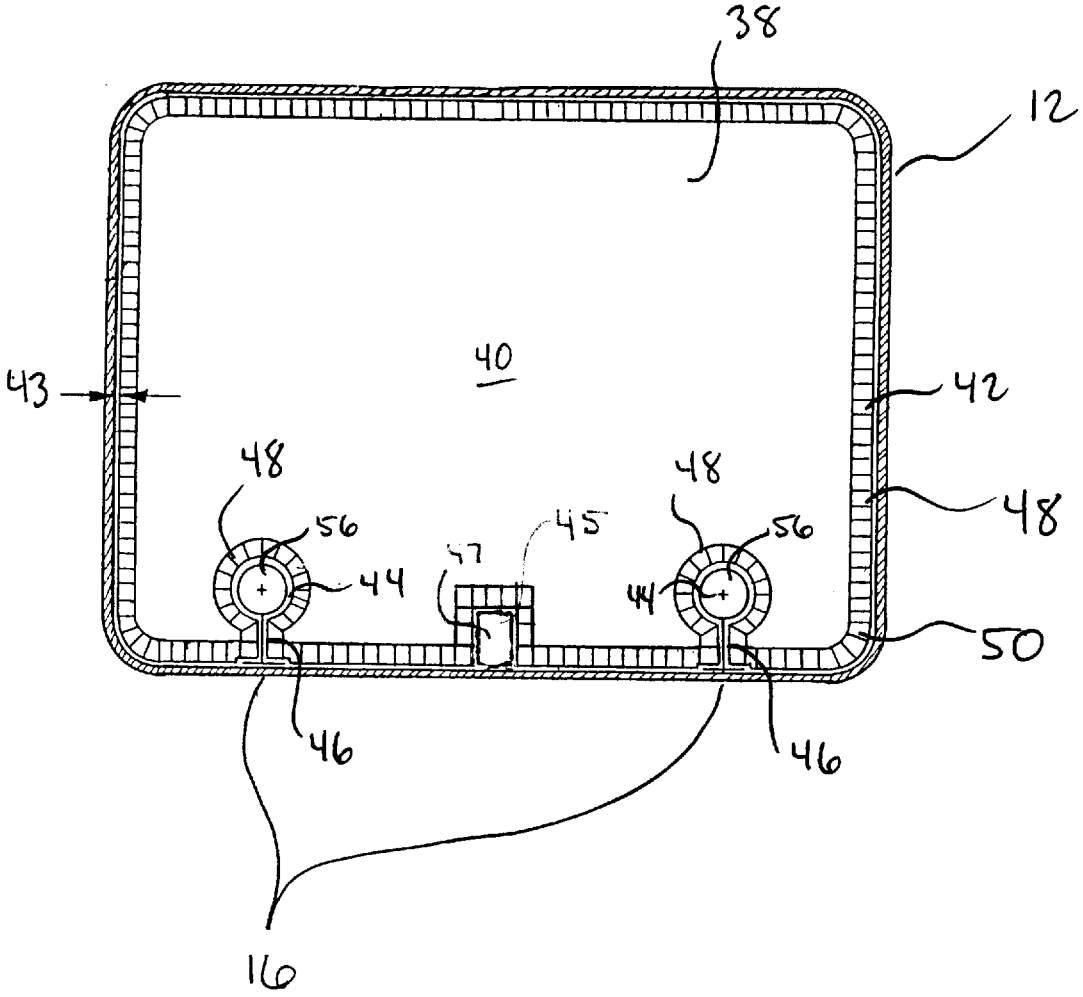

FIG. 2B is a cross-sectional view identical to that of FIG. 2A with the exception that pressure wall 38 is further provided with a rectangular aperture 45 located at its periphery 42. For example, aperture 45 may be located centrally between apertures 44 as shown in the drawings. Aperture 45 preferably accommodates a utility device 47 used for braking, stopping, latching or propelling the vehicle. For example, the utility device 47 may preferably comprise the brake rail of a friction brake system (not shown) in which the vehicle 14 is provided with brake calipers which engage the brake rail. A friction brake system could be used, for example, to brake the vehicle 14 as it reaches the end of its predetermined path as in FIG. 6A, or other sections of the ride. Where the utility device 47 is located outside of tube 12, aperture 45 is preferably occupied during launch, for example by a utility plug, thereby minimizing leakage through aperture 45 during launch. It will be appreciated that more than one utility device 47 may be incorporated in the ride, that a number of shapes can be used, and that it can also be integrated with the track, depending upon the design requirements.

Preferably, as shown in FIGS. 2A and 2B, resilient sealing means 48 are provided along the outer periphery of the pressure wall 38, and along the peripheries of the apertures 44 and 45. The resilient sealing means 48 may preferably comprise a plurality of resilient fingers 50 which can bend out of the way in the event foreign objects become lodged between the pressure wall 38 and the inner surface 22 of launch tube 12. The use of resilient fingers 50 is preferred over a continuous annular component to prevent complete loss of the substantial seal, resulting in loss of braking, in the event a foreign object becomes caught between the tube 12 and the resilient sealing means 48. Even if several of the resilient fingers 50 become detached from the sealing means 48, the vehicle 14 will still be substantially braked. An example of a suitable resilient material is fiber-reinforced rubber or the like, as used in conventional rubber tires.

In order to minimize the amount of aerodynamic drag on the vehicle 14 as it is propelled along its path, the vehicle 14 preferably has an aerodynamic shape. For example, a fairing may be installed on the front and/or rear of the vehicle 14. Furthermore, the transition between the passenger compartment 34 and the pressure wall 38 may be smoothly shaped, or the fairing may form part of the pressure wall 38 as mentioned above.

Retracting the peripheral portion of the pressure wall 38 when the vehicle is outside the tube can also minimize aerodynamic drag. For example, this can be accomplished by employing fingers at the periphery that can be deployed pneumatically (not shown), or by a partial or whole pressure wall that can be folded out of the way (not shown).

It will also be appreciated that the vehicle 14 can be propelled by conventional propulsion means to compensate for air drag and/or other friction, or as a secondary propulsion system. Such propulsion means may preferably comprise linear synchronous motors (not shown) or electrically driven wheels (not shown) that engage the track and/or a rail in the space provided by the utility device 47. In the case where friction is being compensated for, real time feedback from position sensors positioned along the track 16 or the like can be used to control the propulsion means.

The outer surface of the passenger vehicle 14 is also provided with one or more guide points 51 which engage the track 16 to thereby allow the vehicle 14 to be guided along its predetermined path. The guide points 51 are described in greater detail below in conjunction with the track 16.

The guidance means for guiding the vehicle 14 along its pre-determined path preferably comprises a self-rigid track 16 which has an inner portion 52 extending along, and in close proximity to, the inner surface 22 of the launch tube 12, and an outer portion 54 extending outwardly of the first open end 26 of the launch tube 12. As used herein, the term "self-rigid" means that the track derives its rigidity from its structure, as in, for example, a conventional coaster track design.

In the preferred embodiment shown in FIG. 1, the track 16 comprises a pair of rails 56 arranged in parallel spaced relation to one another. However, it will be appreciated that the track 16 may instead comprise a monorail design or may utilize more than two rails. Furthermore, a support structure (not shown) is preferably provided to support the track 16 and tube 12. Details of the support structure have been omitted from FIG. 1 for clarity, but are described below in relation to other of the preferred embodiments.

In a launch and re-entry amusement ride as illustrated in FIG. 1, the vehicle 14 is launched from the first end 26 of the launch tube and subsequently re-enters the first end 26 of the launch tube 12 under the influence of gravity. In order to allow the vehicle 14 to re-enter the tube 12, the outer portion 54 of the track 16 has a substantially vertical portion 60 where the track 16 becomes elevated above the first end 26 of the launch tube 12. The vehicle 14 travels along track 16 to vertical portion 60, where it reaches a point of maximum elevation 62 relative to the first end 26 of the launch tube 12. It will be understood that the point of maximum elevation 62 may vary depending on a number of factors such as the configuration of the track 16 and the tube exit velocity of vehicle 14.

Once the vehicle 14 reaches the maximum point of elevation 62, it changes direction and begins to accelerate downwardly under the force of gravity, being guided along track 16 back into the first end 26 of the tube 12. In order to guide the vehicle 14 back to the launch tube 12, it will be appreciated that the track 16 is preferably inclined relative to a horizontal plane at the point 62 where the vehicle 14 changes direction.

Although the path along which track 16 extends in FIG. 1is relatively simple, the use of a self-rigid track allows a wide variety of possible paths of travel, some of which are described below in relation to other preferred embodiments of the invention. Furthermore, although the rails 56 are shown in FIGS. 1, 2A and 2B as having a circular cross-section, they may have a variety of other cross-sections, such as triangular or rectangular (not shown).

As mentioned above, the passenger vehicle is provided with one or more guide points 51. In rides where relatively high loads are seen, such as with conventional coaster track configurations, the guide points preferably comprise conventional rollers. On the other hand, sliding bearings may be preferred where the loads are low, such as with a substantially straight and vertical path of travel. Furthermore, more than one roller or sliding surface may be required to restrain each guide point to the track to prevent uplift or excessive side to side movement of the vehicle 14.

It will be appreciated that other conventional bearings may be utilized at the guide points, such as air bearings, or magnetically levitating bearings, depending on what is most suitable for each particular ride.

In the embodiment shown in FIG. 1, a total of four guide points 51 are provided, with two guide points being provided on each side of the vehicle 14, one adjacent the front end 32 and one adjacent the rear end 34. The guide points 51 of the amusement ride 10 are of the rolling type, preferably comprising rollers which engage the rails 56 of the track 16 and prevent the vehicle from separating from the track 16.

The pressurized gas source 18 introduces pressurized gas into the substantially sealed space 36, to cause an increase in pressure in the space 36 sufficient to launch the vehicle 14 out of the launch tube 12 with a desired tube exit velocity. Several methods are known for pressurizing the space 36, of which two methods, namely compressed air energy and elevated mass energy, are now discussed below. It will be appreciated that any suitable gas, for example air and nitrogen, can be used. However, air is the most preferred gas due to economy and safety.

Figure 3:
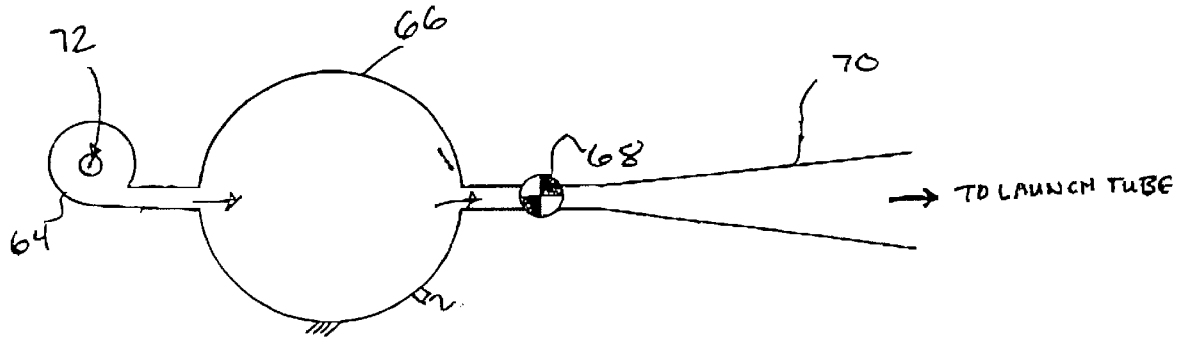
FIG. 3 is a schematic view of a compressed air energy system for use in the amusement ride of the present invention.

A preferred pressurized gas source 18 utilizing compressed air energy is schematically illustrated in FIG. 3, and comprises an air blower 64, a storage tank 66, a valve 68 and a duct system 70. The air blower 64 may preferably comprise a blower which typically delivers a low pressure and a high flow rate the preferred pressure and flow rate depending on the requirements of the ride. The air blower 64 delivers the air from an inlet 72 to the storage tank 66 where the air is stored in a pressurized form.

The valve 68 is positioned in the duct system 70 connecting the air storage tank 66 to the substantially sealed space 36 of the launch tube 12. The valve 68 is adapted to pass a considerable volume of air, and to open and close relatively quickly, preferably on the order of fractions of a second. The throat size of the valve, that is the diameter of the passage through the valve when it is completely open, need not be as large as the launch tube 12 as a high flow rate can be achieved through a relatively small throat size, which may be on the order of from about 0.2 m to about 2 m, more preferably from about 0.2 m to about 1 m.

The valve 68 may be configured to simply open or close, or to meter the flow so as to achieve a relatively constant acceleration of the passenger vehicle 14 during launch. Furthermore, metering of the gas will enable a consistent tube exit velocity of passenger vehicle 14 to be achieved independent of the total passenger weight. Preferably, the valve 68 is controlled on a real time basis, using feedback from position sensors which monitor the progress of the vehicle as it is being launched. The operation of the valve 68 is preferably controlled by a facility computer or dedicated system (not shown).

While metering the flow of gas entering the substantially sealed space 36 can be used to control the tube exit velocity and compensate for differences in passenger weight, other means can also be used. For example, an exhaust valve may be provided which can be opened at a calculated time to relieve pressure. The exhaust valve is preferably also controlled on a real time basis.

It will be appreciated that the compressed air energy source 18 shown in FIG. 3 can be configured to deliver pressurized air several times in a row to launch the passenger vehicle 14 in a repetitive manner. As well, the pressure source 18 can be configured for partial or full launch of the vehicle.

Figure 4:
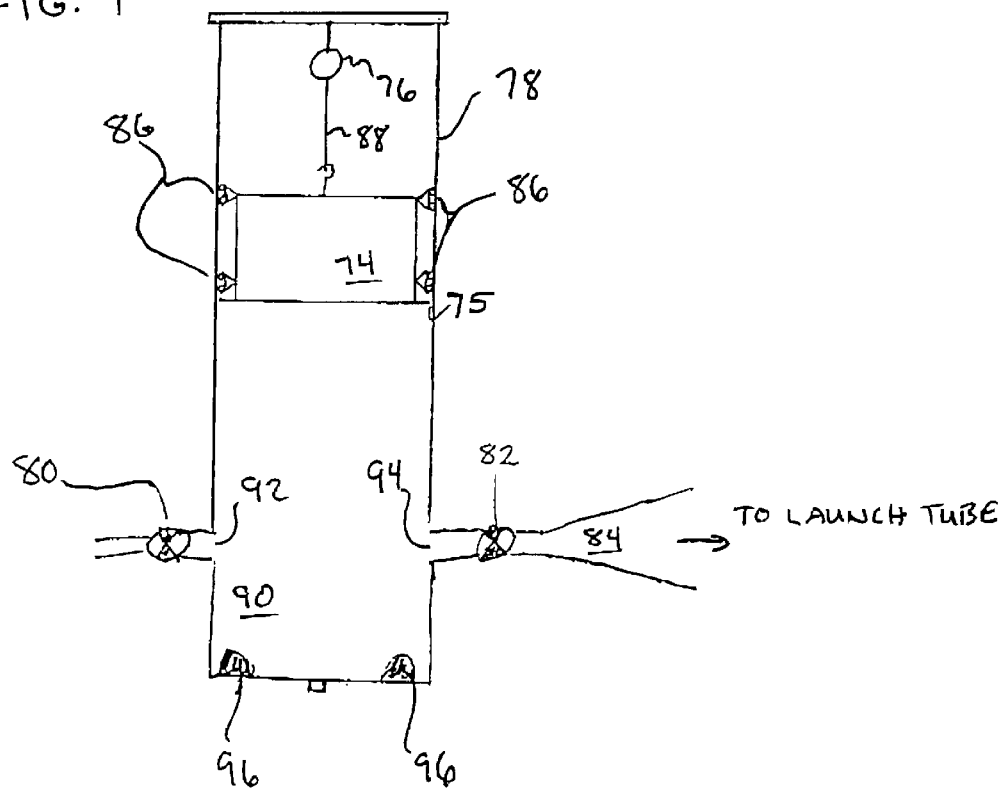
FIG. 4 is a schematic view of an elevated mass energy system for use in the amusement ride of the present invention.

A preferred configuration of an elevated mass energy system is shown in FIG. 4, comprising a piston 74, a winch 76 to raise the piston 74, a sleeve 78 in which the piston is contained, an inlet check valve 80, a control valve 82 and a duct 84 through which pressurized air is supplied to the tube 12. The piston 74 preferably has an area of about 4 times the area of the launch tube 12 and a mass of about 16 times that of the vehicle 14, in order to achieve an acceleration of about 3 or 4 g's. The piston 74 is preferably guided through the sleeve 78 by rollers 86 or slide bearings (not shown) mounted to the outside surface of the piston.

Preferably, the gap 75 between the sleeve 78 and the piston 74 is very small to minimize air leakage. The winch 76 is adapted to slowly raise the piston 74 between ride launches, for example every 30 to 120 seconds. The winch 76 releases the cable 88 to which the piston 74 is attached in order to initiate the launch. Preferably, a dead volume 90 is provided inside sleeve 78 below the valve inlet and outlet ports 92 and 94 to brake the piston 74 and stops 96 to bring it to rest in the bottom of the sleeve 78. The inlet check valve 80 opens during raising of the piston 74 to allow outside air to be drawn into the sleeve 78, and closes as the piston 74 is released. The control valve 82 is present only for safety in the event the piston 74 is inadvertently released, and is opened prior to release of the piston 74. A real time control means as discussed above is also preferably incorporated into the elevated mass energy system.

In addition to having a pressure source 18 as described above, it is possible to incorporate a pressure sink (not shown) into ride 10. A pressure sink acts to regenerate some of the kinetic and/or potential energy of the vehicle 14 as it is being braked. It can be used for example in a tower ride in which the vehicle 14 is to be bounced upwardly after it re-enters the tube 12. Regenerated pressure can be used on its own or in conjunction with the pressure source to re-launch the vehicle 14. The pressure sink consists of a storage device, such as a large enclosed volume which, for example, is defined by the emergency brake section, the pressure source tank, or a separate tank.

Having now described the basic principles of operation of the invention, a number of other preferred embodiments are now discussed below.

Figure 5A:
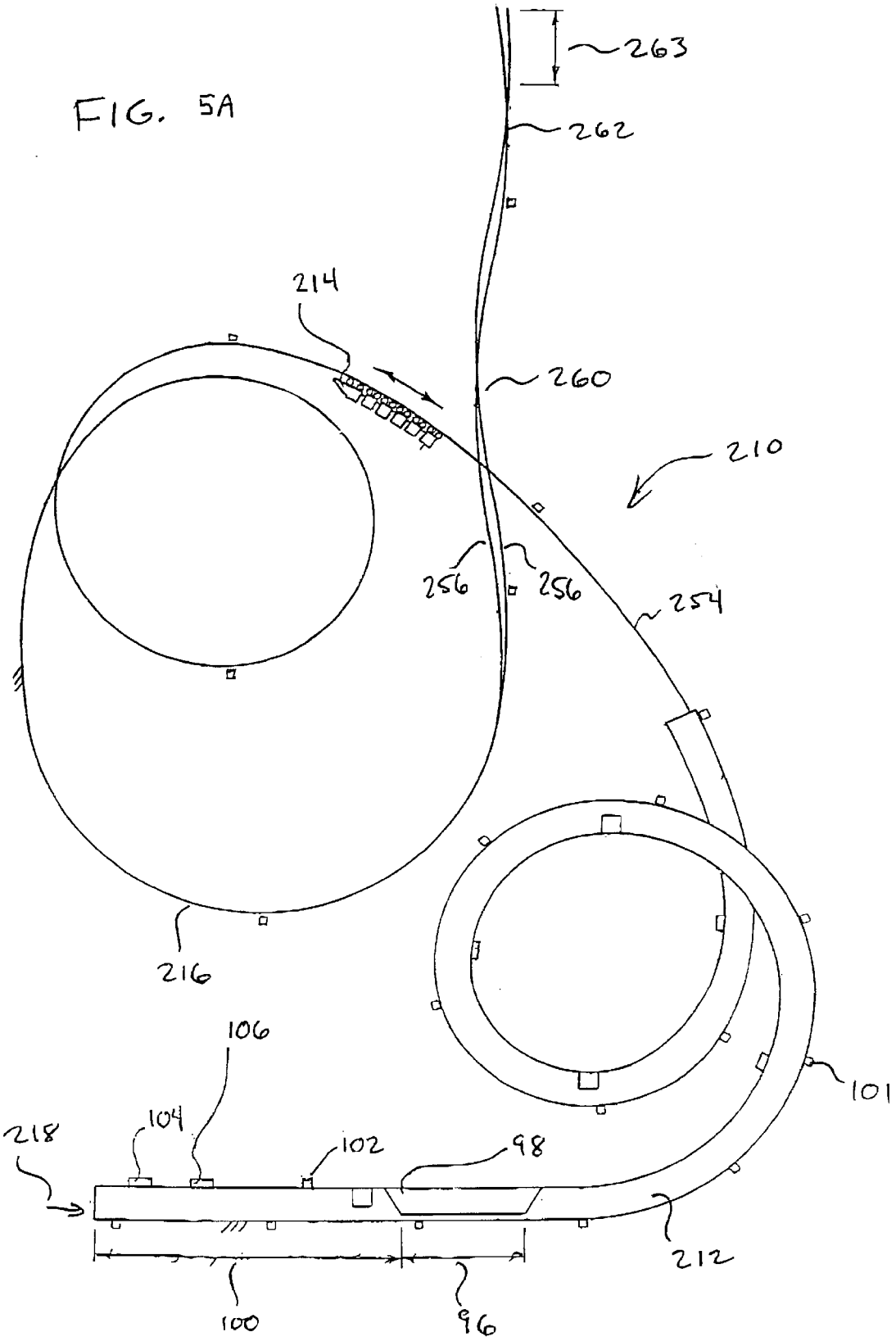
FIG. 5A is a schematic view of an amusement ride according to a second preferred embodiment of the present invention.

A second preferred amusement ride 210 is schematically illustrated in FIG. 5A and comprises a ride which combines features of a launch and re-entry ride and a coaster ride. The amusement ride 210 includes a hollow launch tube 212 (which also serves as a re-entry tube) having a series of curves, an articulated passenger vehicle 214 adapted to changing directions, a track 216 having a series of curves and twists, and a pressurized gas source 218.

Figure 5B:
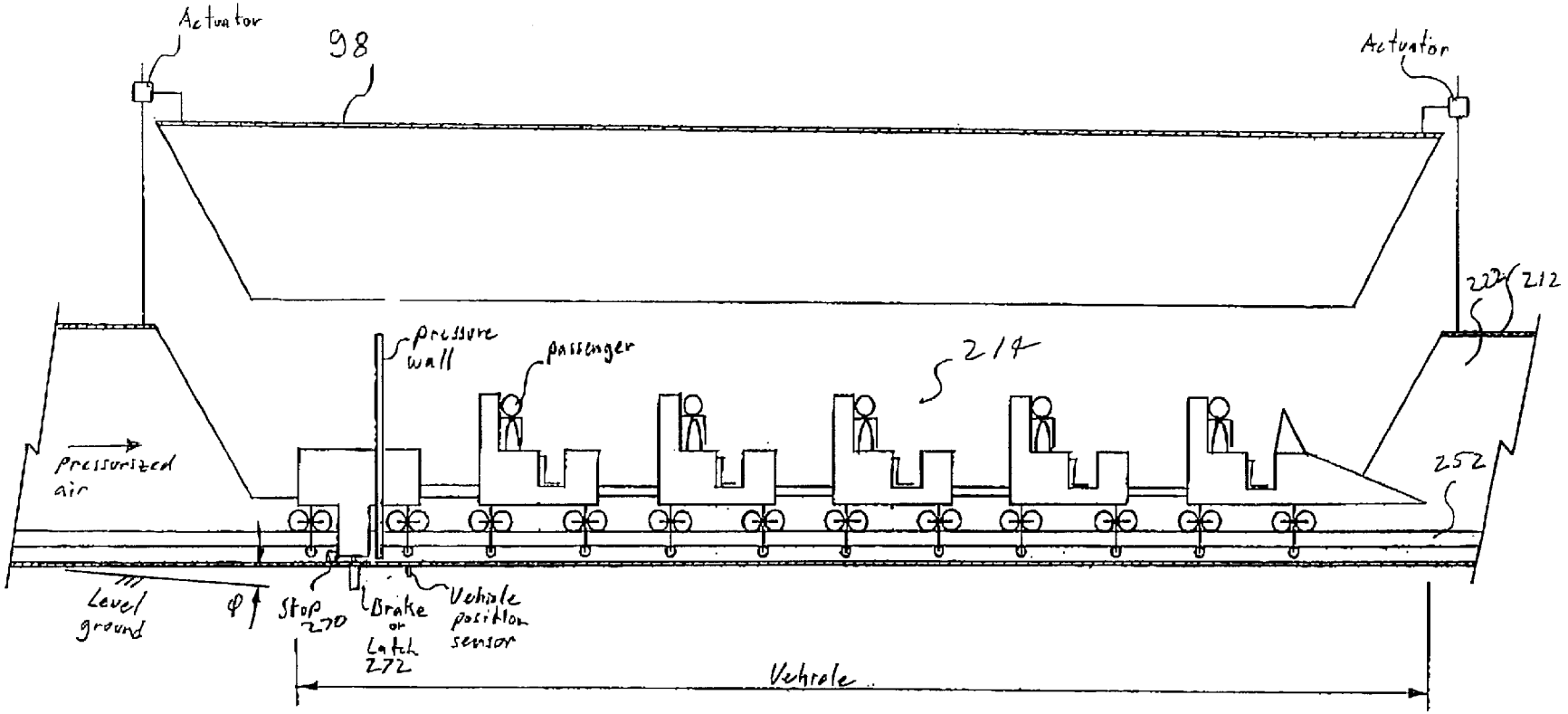
FIG. 5B is a cross-sectional view of the breech area of the second preferred embodiment.

As in the embodiment illustrated in FIG. 1, the track 216 is self-rigid and comprises a pair of rails 256 which are in parallel spaced relation to one another, also referred to as "constant track gauge". As in the first embodiment, details of the support structure are absent from FIG. 5A. The track 216 has an inner portion 252 (FIG. 5B) which extends along, and in close proximity to, the inner surface 222 of the launch tube 212 throughout its length. The outer portion 254 of the track 216 includes an upwardly inclined portion 260 at which the vehicle 214 reaches its point of maximum elevation 262. The track 216 extends upwardly beyond the point of maximum elevation 262 to provide an emergency braking section 263. Furthermore, in the upwardly inclined portion 260 the rails 216 are twisted about the predetermined path so as to produce controlled rotation, or "rolling", of the vehicle 214 about its predetermined path.

The second embodiment of the invention is also provided with a number of features which are not illustrated in FIG. 1. For example, the launch tube 212 includes a breech section 96 located at the base of the ride 210. The vehicle 214 is positioned in the breech section 96 when it is launched and returns to the breech section 96 upon re-entry. The breech section 96 can be oriented at any angle, but is shown as being substantially horizontal in FIGS. 5A and 5B. Preferably, however, the breech section 96 is angled slightly relative to the horizontal to enable the vehicle to move back under the influence of gravity to the rear of the breech section 96, where it comes to rest against stops 270 and held in a home position by latches, brakes or the like 272. It is also possible to propel the vehicle 214 back by applying a vacuum (not shown) to the rear of the vehicle 214. A vacuum source may preferably comprise a blower, tank, and a control valve, similar to a compressed air energy system with the blower turned around so that it is configured for vacuum.

It will be appreciated that it is possible to hold onto the vehicle with a brake for a short period after the pressure source has been applied to let the pressure reach a nominal value, such that the vehicle will accelerate more rapidly after it is released. This may be accomplished simply by the use of an eddy current brake.

The breech section 96 is preferably provided with at least one door 98 through which passengers and/or the vehicle 214 can exit/enter the tube 212. The door 98 preferably forms an airtight seal when it is closed and is provided with a safety mechanism which prevents the door 98 from opening while the vehicle 214 is moving.

It will be appreciated that more than one vehicle can be used in the amusement ride 210 to increase throughput of passengers. For example, a vehicle finishing its ride can be removed or switched from the breech section 96 through door 98 and replaced by another vehicle that is starting the ride. In this way, passengers can board and depart the vehicles more efficiently outside of the breech section 96. Also, it will be appreciated that the vehicle can be designed in two pieces (not shown), a carrier piece comprising a chassis with guide points engaging the track, and one or more passenger cartridge pieces which can be removed or loaded from the carrier piece through doors 98 of the breech section.

The amusement ride 210 may also be provided with a number of additional features, most of which enhance safety. For example, the ride 210 may preferably be provided with an emergency brake section 100 rearward of the breech section 96 in the event the vehicle 214 has not braked sufficiently by the time it has reached its home position. In such an event, the stops 270 are preferably designed to be knocked out of the way so that the vehicle 214 can pass into the emergency brake section 100. The emergency brake section 100 can utilize conventional brake technology, such as friction or eddy current brakes.

Vehicle position sensors 101 may preferably be provided along the tube 212 and track 216 to monitor the position of the vehicle 214. A pressure relief safety valve 104 can be provided rearward of the home position to limit the air pressures and consequently limit the forces on the vehicle 214. One or more control exhaust valves 106 located along the tube 212 (including the emergency braking section 100) may also be provided to adjust the pressures both during launch and re-entry. An air pressure sensor 102 can be installed behind the vehicle home position to ensure the pressure remains within a safe range. In the event that pressures rise too high, the control exhaust valve(s) 106 can be configured to open. Lastly, a facility computer or the like (not shown) is preferably provided to control a number of functions of the ride, including control of the vehicle during launching and re-entry, lock and release of the vehicle at the home position, operation of the doors, etc.

Figure 6A:
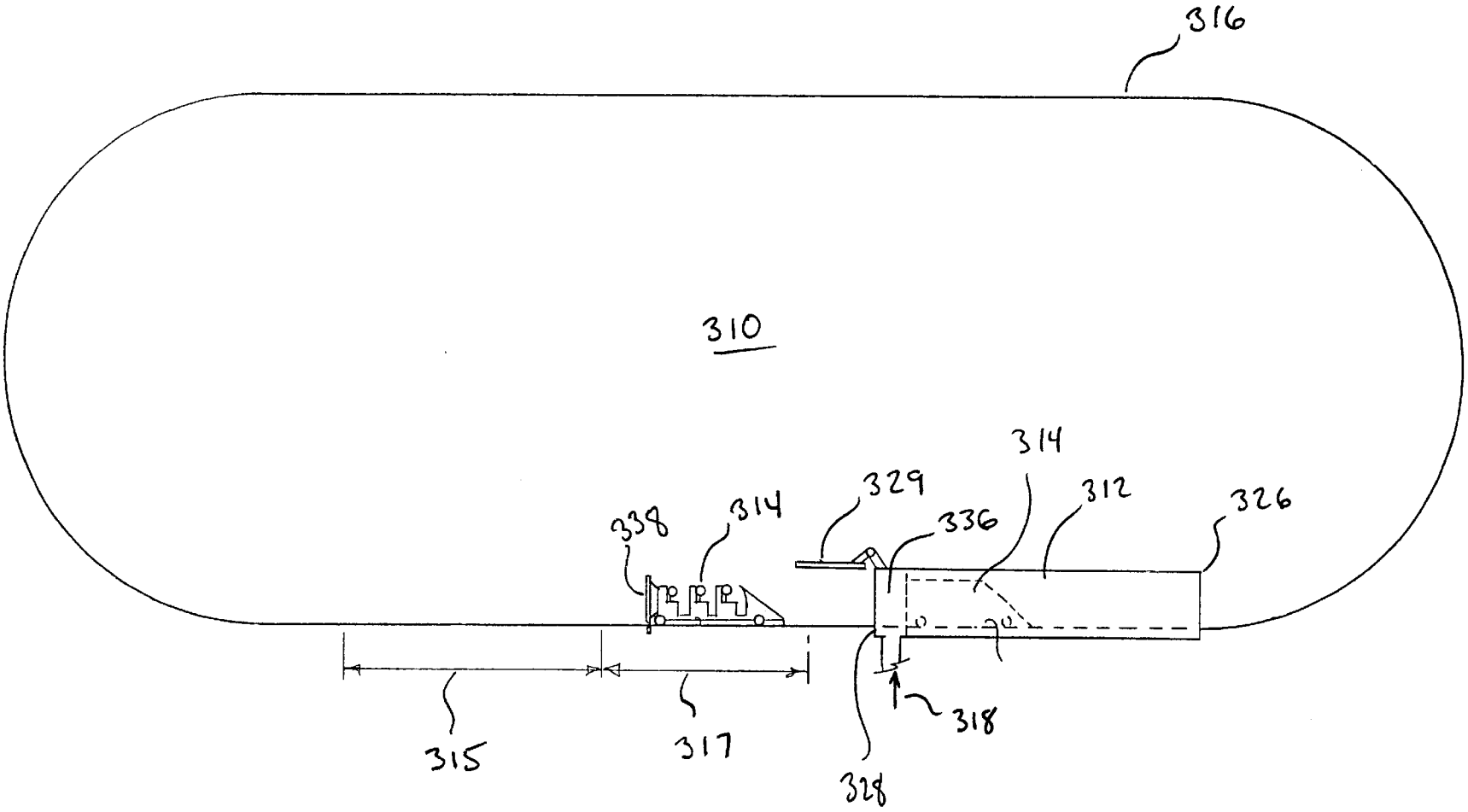
FIG. 6A is a schematic view of an amusement ride according to a third preferred embodiment of the present invention.

FIG. 6A schematically illustrates an amusement ride 310 according to a third preferred embodiment in which the pre-determined path along which the track 316 extends comprises a continuous loop in which the vehicle 314 is launched from the first end 326 of the tube 312 and is guided toward the opposite second end 328 of the tube 312. This ride is similar to a conventional coaster ride with the lift hill of the coaster being replaced by a launch capability.

As shown in FIG. 6A, the second end 328 of the tube 312 includes a door 329 which can be opened to permit the vehicle 314 to enter the tube 312 through the second end 328. The door 329 is closed prior to launch of the vehicle 314 to form a substantially sealed space 336 rearward of the vehicle pressure wall 338. The pressure source 318 is preferably located on the side wall just inside the second end 328 of tube 312. The vehicle 314 in its home position is shown in dotted lines.

In the third preferred embodiment shown in FIG. 6A, the vehicle 314 is braked prior to entering the second end 328 of the tube 312. Therefore, a braking section 315 is preferably provided rearwardly of the tube 312 so that the vehicle can be stopped, and passengers unloaded, before it reaches the second end 328 of the tube 312. The braking may be either gradual, due to rolling and aerodynamic losses as the vehicle travels along the track, or abrupt, using conventional friction brakes, eddy current brakes or a separate brake tube at the end of the track as discussed below with reference to FIG. 7.

It will be appreciated that one or more vehicles can be utilized in the amusement ride 310 shown in FIG. 6A for increasing throughput of passengers. Vehicles can be staged at location 317 just behind the breech section, or in an alternative embodiment (not shown), staging can take place off to one or more sides or above or below the breech, in which case the track is discontinuous and doors are located on the side of the breech.

FIG. 6A also provides "re-launch" capability to permit the vehicle 314 to travel around track 316 several times during each ride. For example, after vehicle 314 is launched from tube 312, the door 329 is opened to permit the vehicle 314 to enter the second end 328 of the tube 312. Immediately after entering the tube 312, the door 329 is closed and the vehicle 314 is again launched. To end the ride, the brake 315 is activated to stop the vehicle 314 before it enters the second end 329 of tube 312.

Figure 6B:
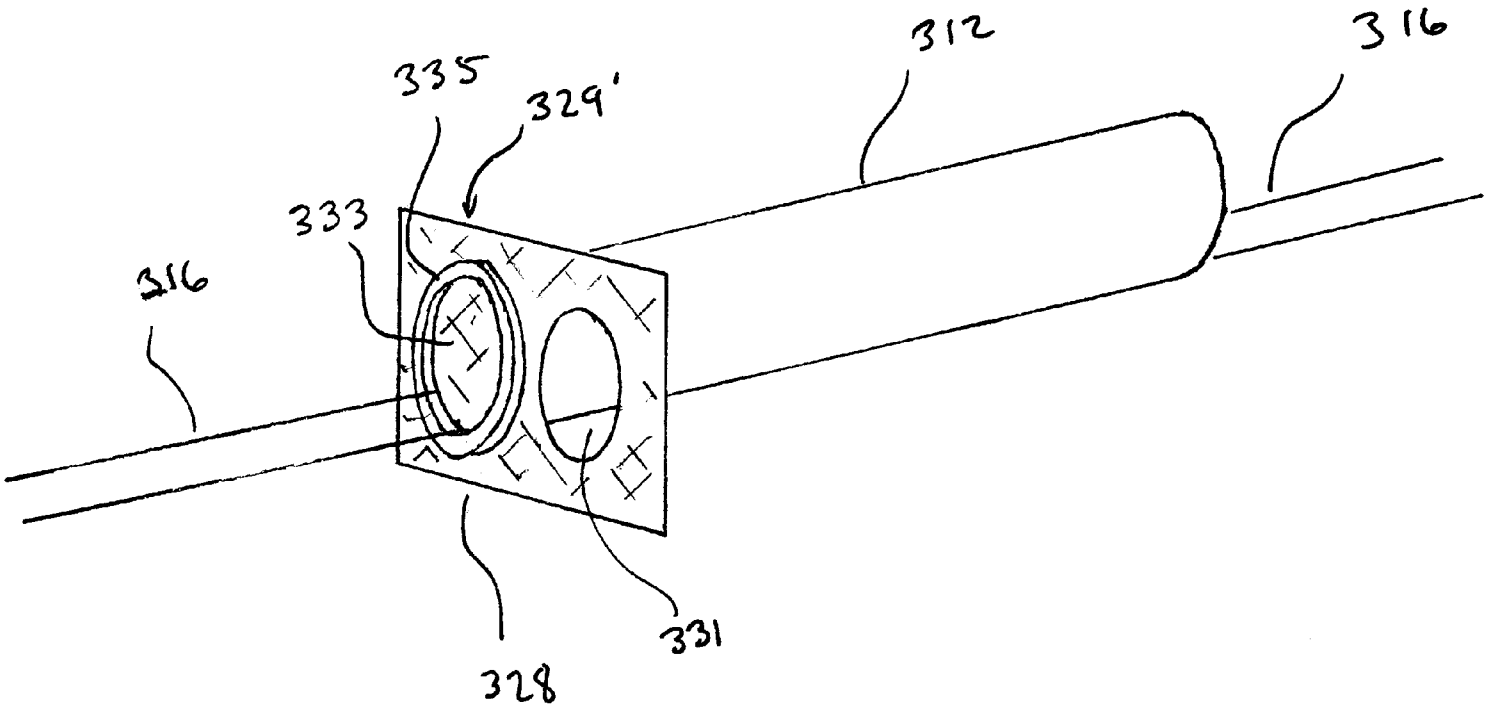
FIG. 6B is a perspective view of an alternate launch tube having a membrane door.

In order to prevent the vehicle 314 from colliding with door 329 in the event it fails to open, the vehicle 314 can be made to travel slowly in the section of track 316 adjacent the second end 328 of tube 312, an interlock brake (not shown) can be incorporated in the track 316 just ahead of door 329, and a bumper (not shown) can be incorporated into the vehicle 314 or the door 329. Alternatively, as shown in FIG. 6B, the door 329' can be made from a membrane such as canvas or other suitable strong, impermeable fabric. The door 329' is slidable back and forth across the second end 328 of tube 312, having an opening 331 on one side and a seal 333 on the other side, the seal being formed by a pneumatic ring 335 which holds the membrane in place against the second end 328 of tube 312. In order to permit sideways movement of the door 329', the track 316 is interrupted at the second end 328 of tube 312. Preferably, the vehicle 314 is provided with a cutting edge (not shown) at its front end to enable it to cut through the door 329' in the event it fails to open.

Figure 6C:
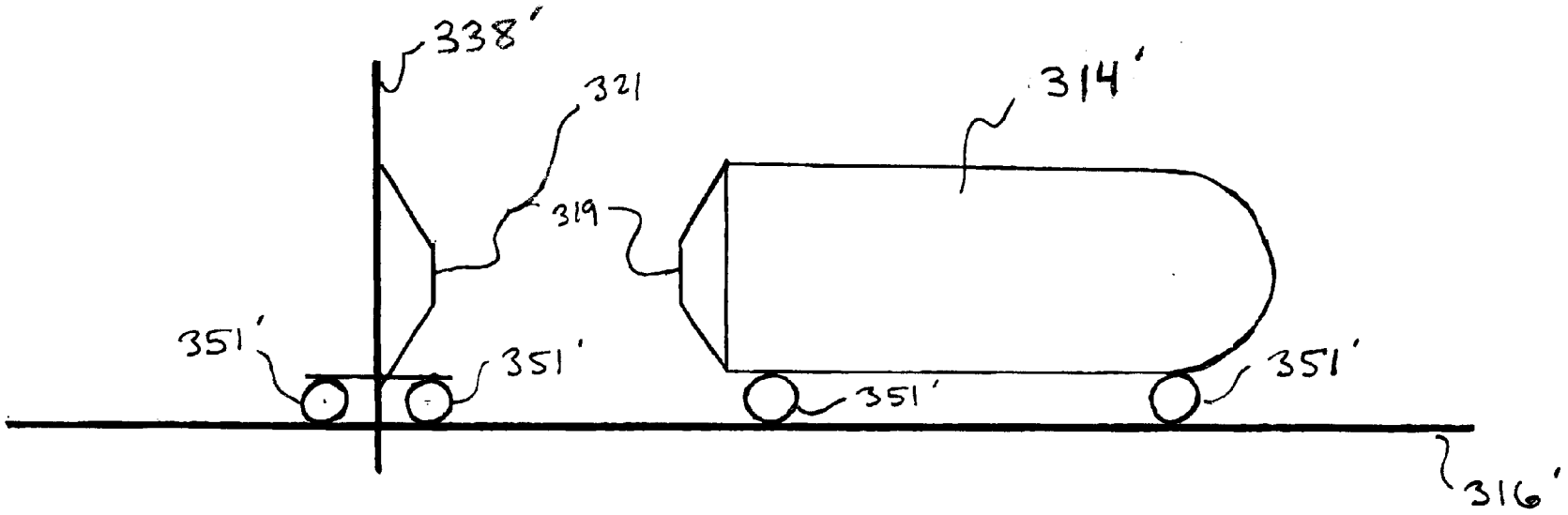
FIG. 6C is a side view of a preferred passenger vehicle being comprised of separable pressure wall and passenger vehicle stages.

When a ride is configured to launch the vehicle 314 only as shown in FIG. 6A (as opposed to launch and re-entry) it becomes possible to split the vehicle 314 into a pressure wall stage 338' and a passenger vehicle stage 314' as shown in FIG. 6C. Each has sufficient guide points 351' that enable them to travel independently along the track 316'. In some cases, it may be more preferred to guide the pressure wall stage 338' on a separate track (not shown), or off the inside wall of the launch tube (not shown) to obtain a better seal.

In the embodiment shown in FIG. 6C, the pressure wall stage 338' and passenger vehicle stage 314' are in contact with one another at launch, for example at mating surfaces 319 and 321 located on the vehicle stage 314' and the pressure wall stage 338' respectively. The two stages 338' and 314' are propelled as one along the tube (not shown). The pressure wall stage 338' is braked near the end of the tube and returned back along the track 316' to the breech section (not shown). The passenger vehicle stage 314' separates from the pressure wall stage 338' and travels along its predetermined path on track 316' by virtue of its own momentum.

The pressure wall stage 338' can be braked in a number of different ways, including conventional friction brakes or eddy current brakes at the utility opening similar to aperture 45 shown in FIG. 2B, for example. Alternatively, it may be preferred to brake the pressure wall stage by a slight negative pressure inside the tube, which can be derived by closing off all ports to the tube or by opening a vacuum port just before it reaches the end of the tube.

The pressure wall stage 338' can be returned back along the track 316' in a number of ways, including gravity feed, self propulsion, or cable or chain winch. Preferably, the vehicle stage 314' travels around the track 316' to return to the breech section of the tube, where it is moved or switched back into the breech just in front of the pressure wall stage 338'.

Figure 6D:
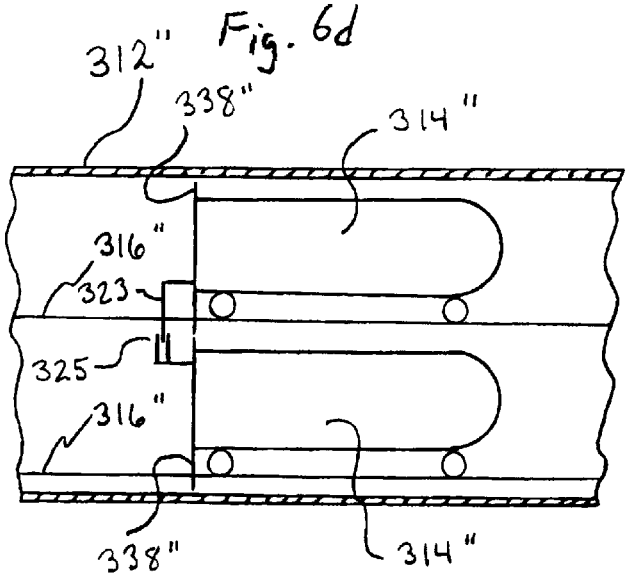
FIG. 6D is a cross-sectional view through an alternate launch tube containing a pair of separable passenger vehicles.

In addition, when a ride is configured to launch the vehicle only as shown in FIG. 6A (as opposed to launch and re-entry) it becomes possible to launch more than one vehicle from a single tube at the same time, as shown in FIG. 6D. The vehicles 314" collectively form a complete pressure wall 338", and are connected by mating means, such as tongue and groove means 323, 325, to keep them aligned inside tube 312". The tracks 316" for each vehicle 314" are aligned in parallel relation to each other inside the tube 312", but may diverge outside of the tube 312", in which case the connection between the vehicles 314" is configured to disengage once they are launched from the tube 312". When the vehicles 314" travel around the tracks 316" to return to the breech section (not shown) of tube 312", they are moved or switched back into the breech.

In an alternate embodiment (not shown), it may be preferred to combine the embodiments of FIGS. 6C and 6D to provide a single disengageable pressure wall stage in combination with a plurality of passenger vehicle stages. The multiple passenger vehicle stages are connected to the pressure wall stage during launch, thereby keeping the passenger vehicle stages in alignment with one another during launch without the need for direct connection between the passenger vehicle stages.

Figure 6E:
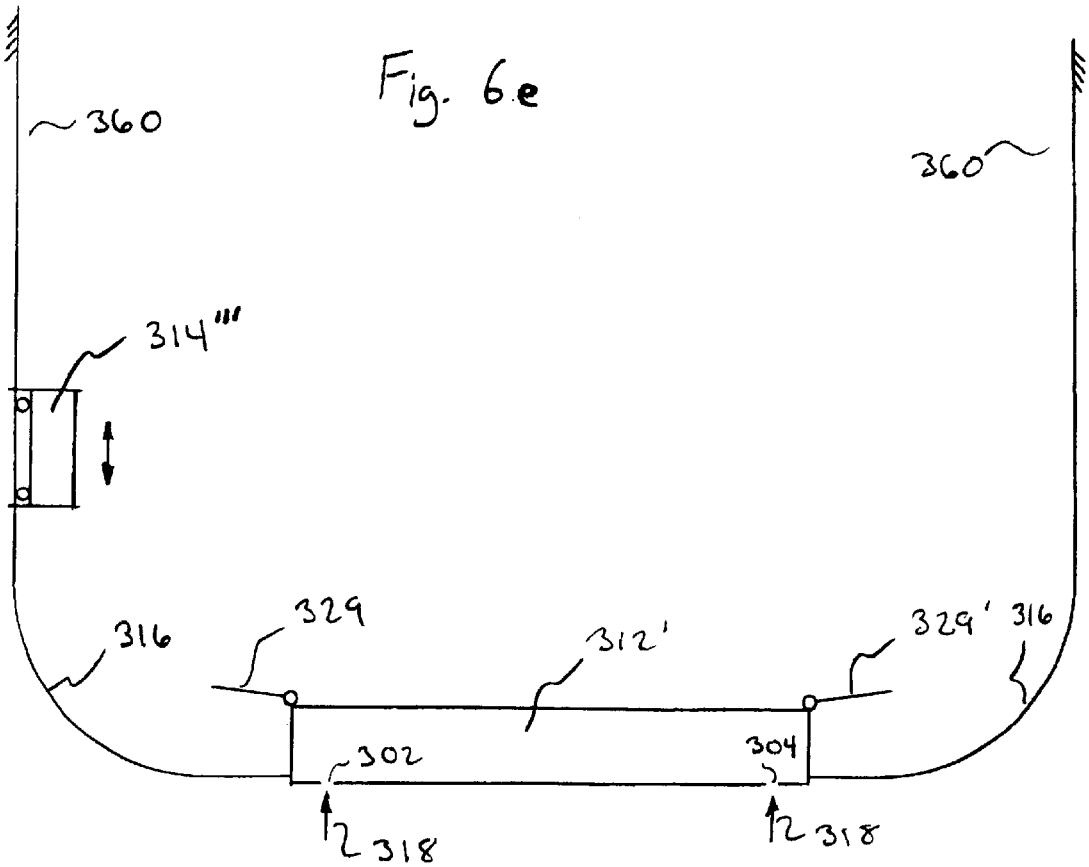
FIG. 6E is a schematic view of an alternate configuration of the third preferred embodiment of the invention.
Figure 6F:
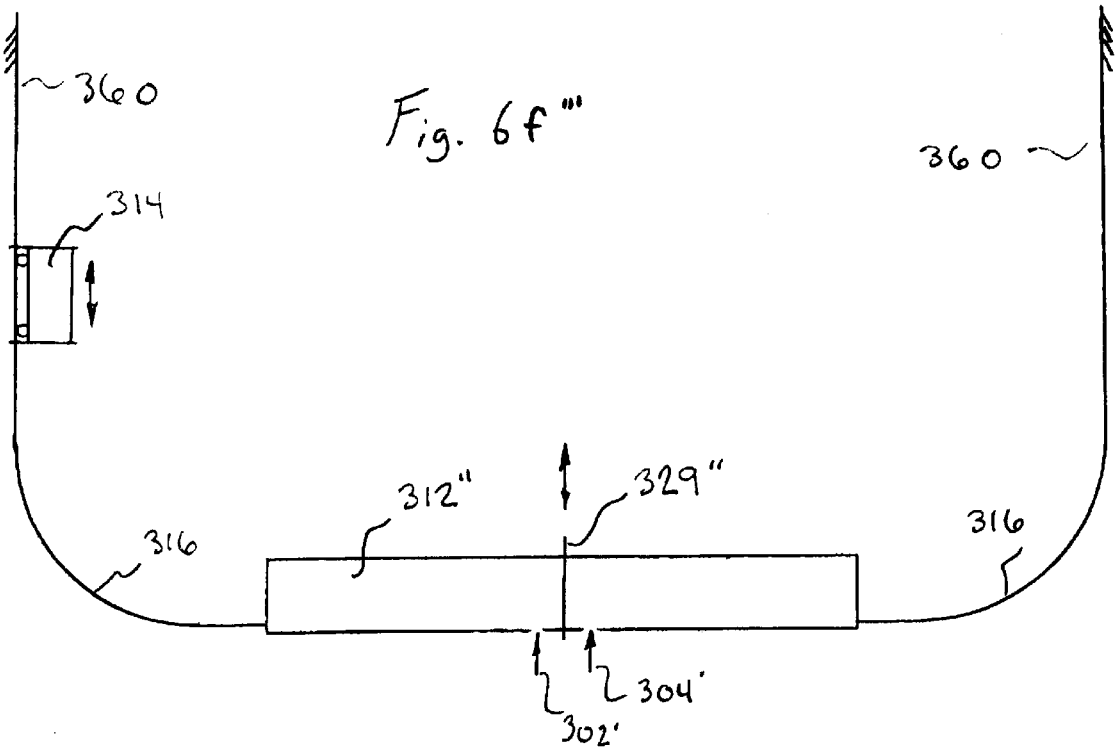
FIG. 6F is a schematic view of a further alternate configuration of the third preferred embodiment of the invention.

FIGS. 6E and 6F show variations on the coaster-type ride of FIG. 6A. In FIG. 6E, two quick opening doors 329 and 329' placed at either end of the launch tube 312' provide the ability to repeatedly launch the vehicle 314'" in a back and forth fashion. Arrows 318 show the location and direction in which air from a pressurized air source (not shown) is allowed to enter the tube 312' through inlets 302 and 304. A potential hill 360 is located on each side of the tube 312' for returning the vehicle 314'", although other configurations are possible.

The ride illustrated in FIG. 6E operates as follows. When the vehicle enters the left side of tube 312', the door 329 is closed while door 329' remains open. Immediately after the vehicle 314'" passes the location of inlet 302, air from a pressurized air source enters the tube 312' through inlet 302, launching the vehicle 314'" from the right end of the tube 312'. Similarly, when vehicle 314'" enters the right end of tube 312', door 329' is closed while door 329 is opened and the vehicle 314'" is launched from the left side of tube 312' by pressurized air entering inlet 304.

FIG. 6F shows how one quick opening door 329" can be configured in a tube 312" to propel a passenger vehicle 314'" back and forth similar to FIG. 6E. Door 329" is centrally located in tube 312" between pressurized air inlets 302' and 304' and operates in a similar fashion to the door shown in FIG. 6B. When the vehicle 314'" enters the left side of tube 312", the door 329" is in its open position. As the vehicle 314'" passes the location of door 329" and air inlet 304', the door 329" is closed and air is allowed to enter the tube 312" through inlet 304', thereby launching the vehicle from the right side of tube 312". Launching the vehicle 314'" from the left side of tube 312" is accomplished in a similar manner, with air being allowed to enter through inlet 302'.

Figure 7A:
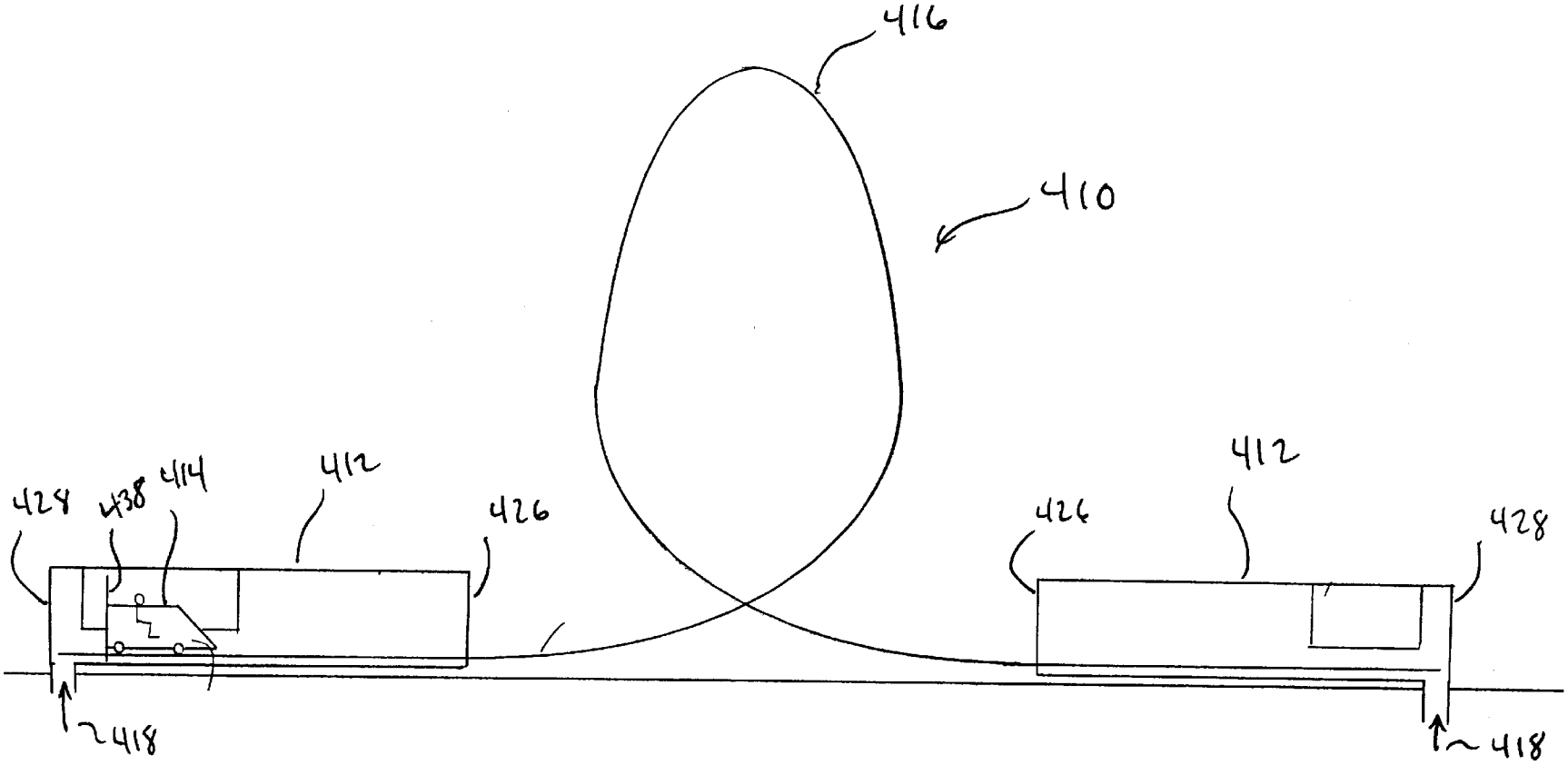
FIG. 7A is a schematic view of an amusement ride according to a fourth preferred embodiment of the present invention.

A fourth preferred embodiment of the invention is shown in FIG. 7A, and comprises an amusement ride 410 comprising a pair of launch/re-entry tubes 412 positioned at opposite ends of a track 416. As is apparent from the drawing, the vehicle 414 can be propelled back and forth between tubes 412 along track 416.

Figure 7B:
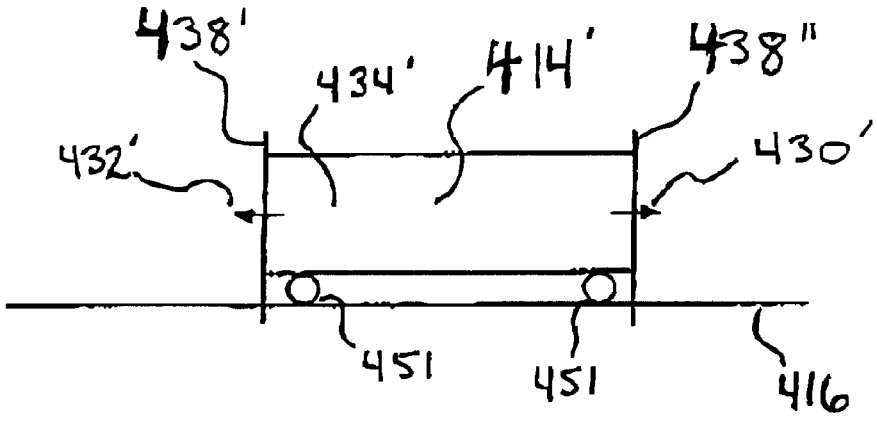
FIG. 7B is a side view of a preferred passenger vehicle having front and rear pressure walls.

FIG. 7B shows a passenger vehicle 414' which may be utilized in the ride 410 of FIG. 7A (as well as passenger vehicle 314''' of FIGS. 6E and 6F), having pressure walls 438' and 438'' on its rearward 432' and forward 430' ends, respectively. This enables pressurized air to act on both ends of the vehicle 414' without direct exposure of the passenger compartment 434' to pressure. However, during launch or re-entry, the "non-active" pressure wall is restricting air flow somewhat, causing some pressure to be experienced by the passenger compartment 434'. This can be eliminated by the addition of a check valve (not shown) to each pressure wall 438', 438'' in order to release any pressure buildup there. It is also possible to incorporate these check valves within the design of the pressure wall seal by allowing air pressure to open the seal or gap slightly. The only disadvantage of incorporating pressure walls 438', 438'' on both sides of the vehicle 414' is that they may obstruct the forward view of the passengers. This concern can be eliminated by sealing off the passenger compartment 434', such that the front of the passenger vehicle 414' becomes a pressure wall.

Figure 8:
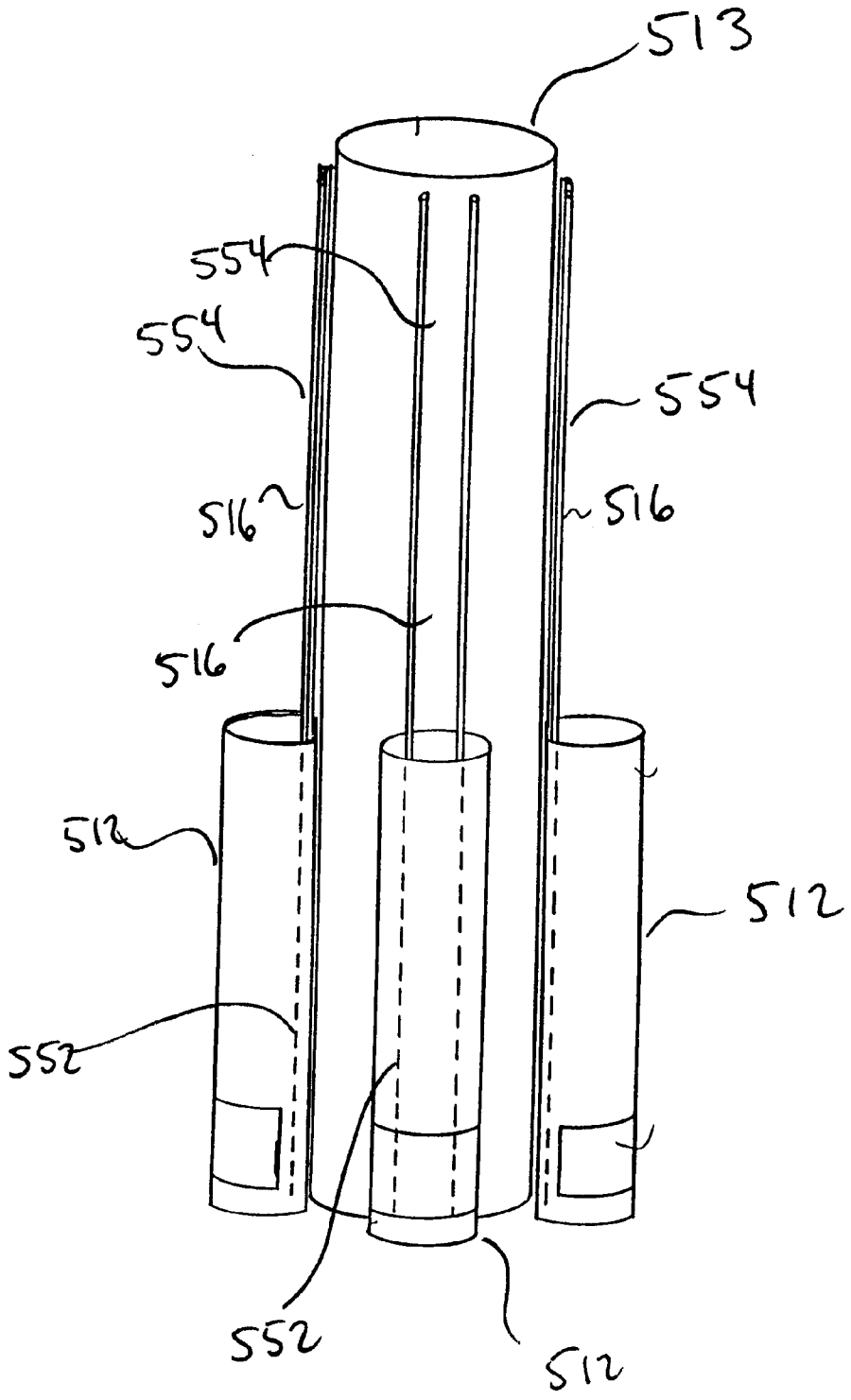
FIG. 8 is a perspective view of an amusement ride according to a fifth preferred embodiment of the present invention.

A fifth preferred embodiment of the invention is shown in FIG. 8, in which a plurality of vertically directed launch/re-entry tubes 512 are arranged about a support tower 513. Each tube 512 is provided with a track 516 along which a vehicle (not shown) is propelled vertically upwardly along the tower 513. The inner portion 552 of the track 516 extends along the inside of the tube 512 in the manner of the embodiment shown in FIG. 1, whereas the outer portion 554 of the track 516 is supported by the support tower 513. It will be understood that FIG. 8 illustrates only one possible type of support structure and that a wide variety of alternate structures are possible.

Figure 9:
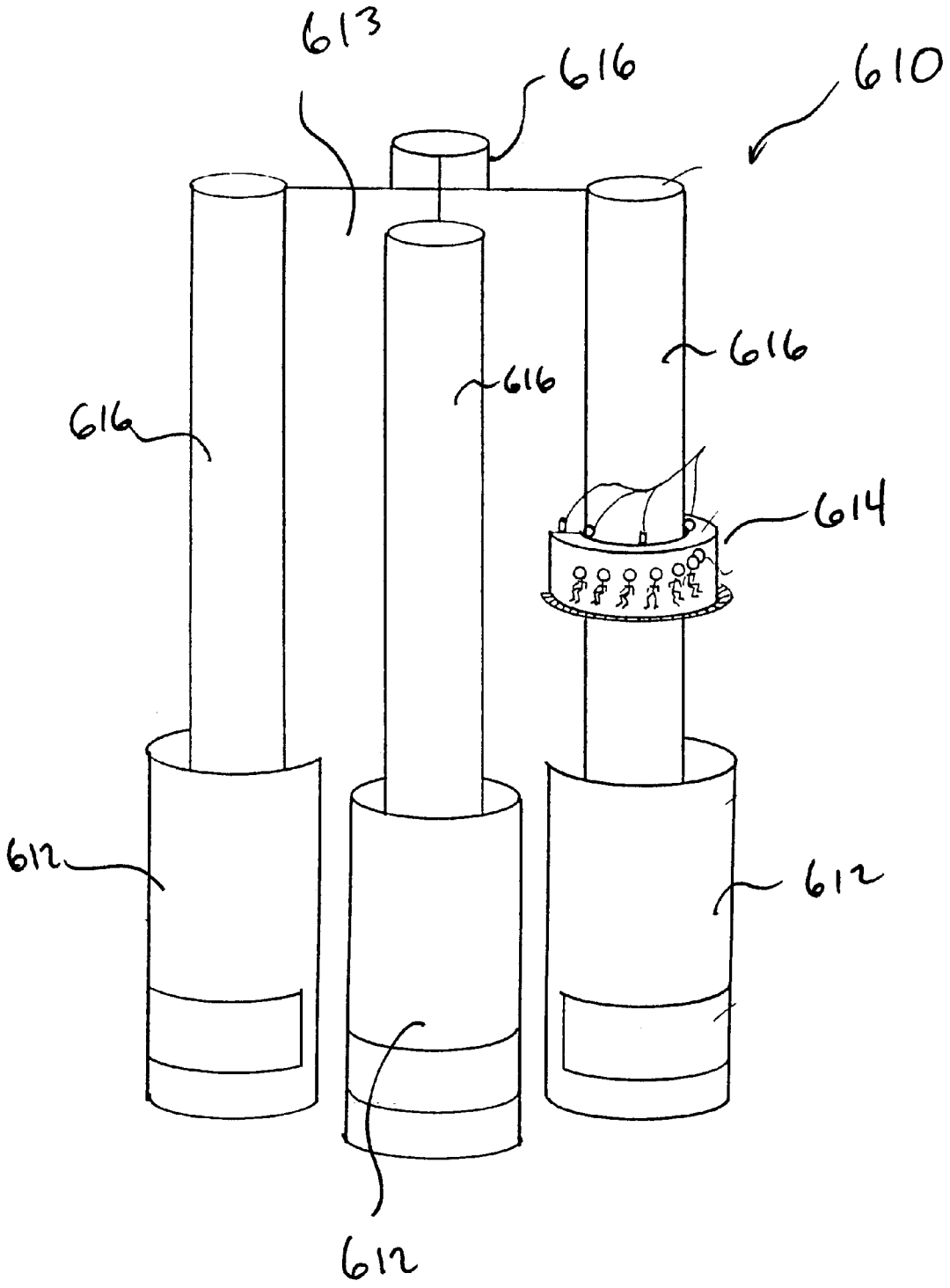
FIG. 9 is a perspective view of an amusement ride according to a sixth preferred embodiment of the present invention.

For example, the sixth embodiment illustrated in FIG. 9 comprises an amusement ride 610 having an alternate support structure for supporting a plurality of launch/re-entry tubes 612, each associated with a track 616, comprising a monorail, and a passenger vehicle 614. The track 616 and the tubes 612 are attached to a support tower 613, with the launch tubes 612 each describing a portion of a cylinder with a flattened side wall, and with the passenger vehicle 614 comprising a C-shaped portion of an annulus.

The monorail track 616 of the sixth preferred embodiment differs substantially in appearance from the track 16 of the first embodiment, comprising a cylindrical tube having a relatively large diameter, but less than that of the launch tube 612. However, despite the difference in appearance, the components and the function of the vehicle 614, launch tube 612 and track 616 are similar to those described above with reference to FIG. 1.

It will be appreciated that the monorail track design shown in the amusement ride 610 of FIG. 9 can include one or more rails (not shown) on the outer surface of the track 616 for controlling the spin of the vehicle 614 about the outer surface of track 616.

Figure 10:
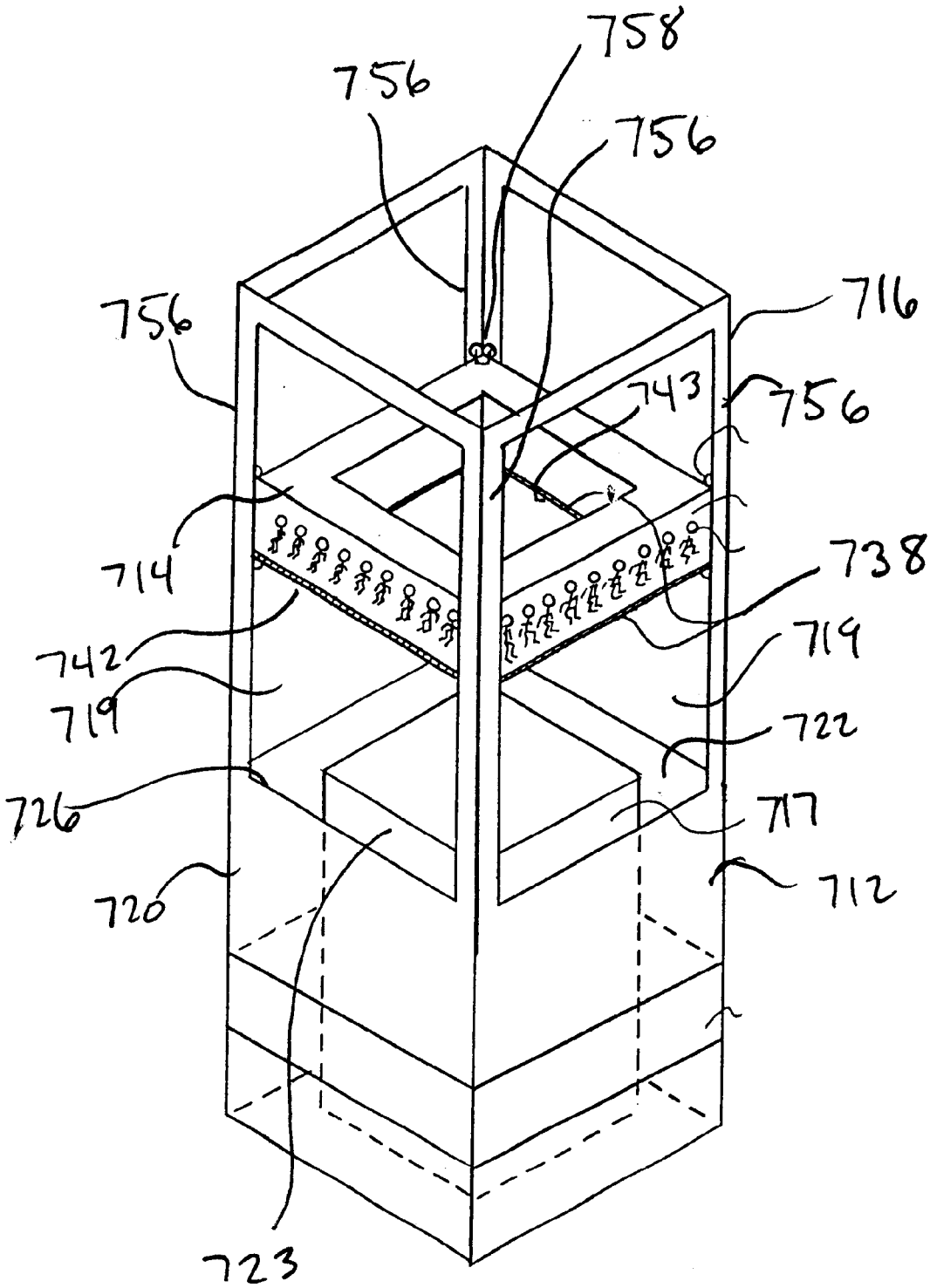
FIG. 10 is a perspective view of an amusement ride according to a seventh preferred embodiment of the present invention.

The seventh embodiment of the invention shown in FIG. 10 includes a central plug member 717 extending centrally through the launch/re-entry tube 712 approximately to its upper end 726. The vehicle 714 comprises an annular body adapted to be received in the annular space between the inner surface 722 of the launch tube 712 and the outer surface 723 of the central plug member 717.

The vehicle 714 includes an annular pressure wall 738 which has an outer periphery 742 forming a substantial seal with the inner surface 722 of the launch tube 712 in the manner described above with reference to FIG. 1. In addition, the pressure wall 738 includes an inner annular periphery 743 which forms a substantial seal with the outer surface 723 of the central plug member 717, in the manner described above with reference to FIG. 1.

As in the previously discussed embodiments, a rigid track 716 is provided extending vertically along the predetermined path from the side wall 720 of the launch tube 712. The rigid track 716 is of the same cross-sectional size and shape as the launch tube 712 and may be integrally formed therewith as a perforated extension of the launch tube 712, such that rail members 756 are defined between perforations 719.

As shown in FIG. 10, the vehicle 714 is guided along the four vertical rail members 756 by guide points 758 provided on the outer surface of vehicle 714. The rail members 756 extend vertically above the first end 726 of the launch tube 712 and above the top of the central plug member 717.

Figure 11:
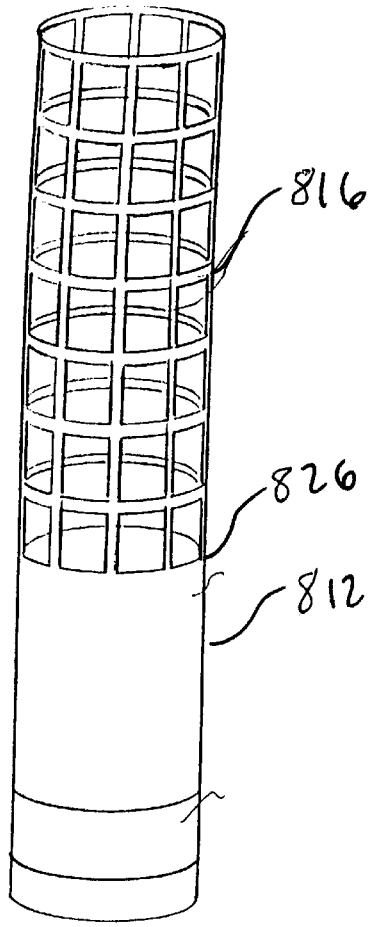
FIG. 11 is a perspective view of the launch tube and the passenger vehicle of an amusement ride according to an eighth preferred embodiment of the present invention.
Figure 11:
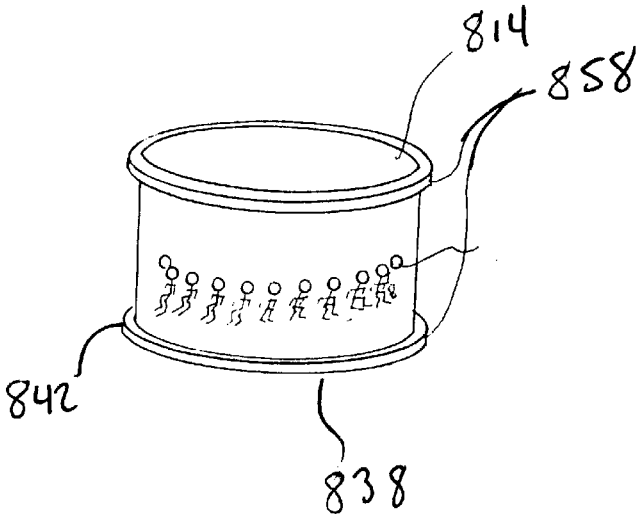

An eighth preferred embodiment of the present invention is illustrated in FIG. 11 and is closely related to the seventh preferred embodiment illustrated in FIG. 10 in that the guidance means comprises a rigid outer guide tube 816 extending vertically upwardly along the predetermined path from the first end 826 of the launch/re-entry tube 812, the rigid outer guide tube 816 being of substantially the same cross-sectional size and shape as the launch tube 812 and preferably integrally formed as a perforated extension of the launch tube 812.

However, the eighth preferred embodiment differs from that illustrated in FIG. 10 in that no central plug member is utilized. The passenger vehicle 814 is guided by the perforated outer guide tube 816 which acts as a track, the vehicle 814 preferably having guide points 858 of the sliding bearing type provided at both its upper and lower edges, the lower edge being coincident with the outer periphery 842 of the pressure wall 838.

Figure 12:
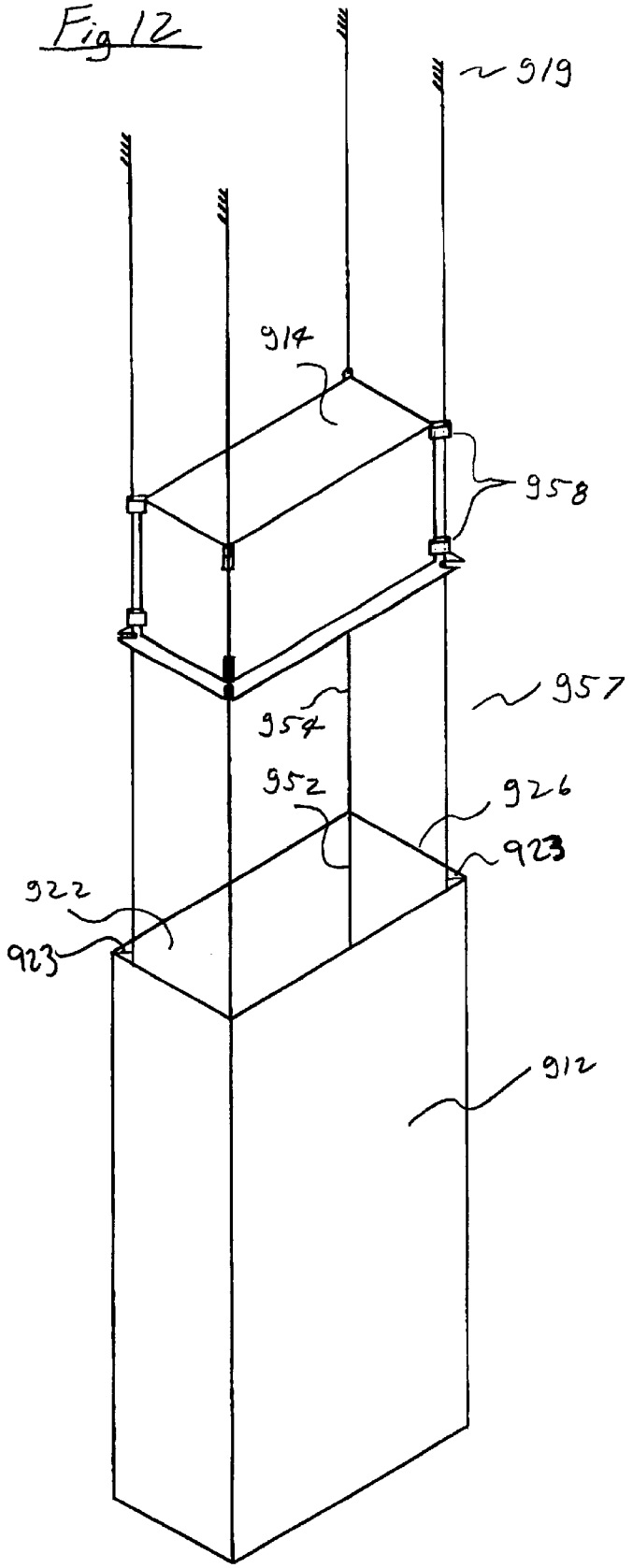
FIG. 12 is a perspective view of an amusement ride according to a ninth preferred embodiment of the present invention.

A ninth preferred embodiment of the present invention is illustrated in FIG. 12. The ninth preferred embodiment is similar in operation to that described in FIG. 1, except that the guidance means comprises a plurality of tensioned cables 957 connected to a support structure 919 beyond the first end 926 of the launch tube 912. A second end of each cable 957 extends into the launch tube 912 through the first end 926, each cable 957 having an inner portion 952 extending along, and in close proximity to, the inner surface 922 of the launch tube 912, and an outer portion 954 extending beyond the first open end 926 of the launch tube 912 to the support structure 919, the guide cables 957 being in substantially spaced, parallel relation to one another. It is preferred that the cables also be secured to the tube exit to prevent them from deflecting due to gravity loads or wind loads. For example, as shown in FIG. 12, connection means 923 are provided proximate the open end 926 of tube 912 to attach the cables 957 to the tube 912 in spaced relation to the inner surface 922 thereof. The vehicle 914 is provided with guide points 958 on its outer surface by which it is guided along the cables 957 throughout its predetermined path.

Figure 13:
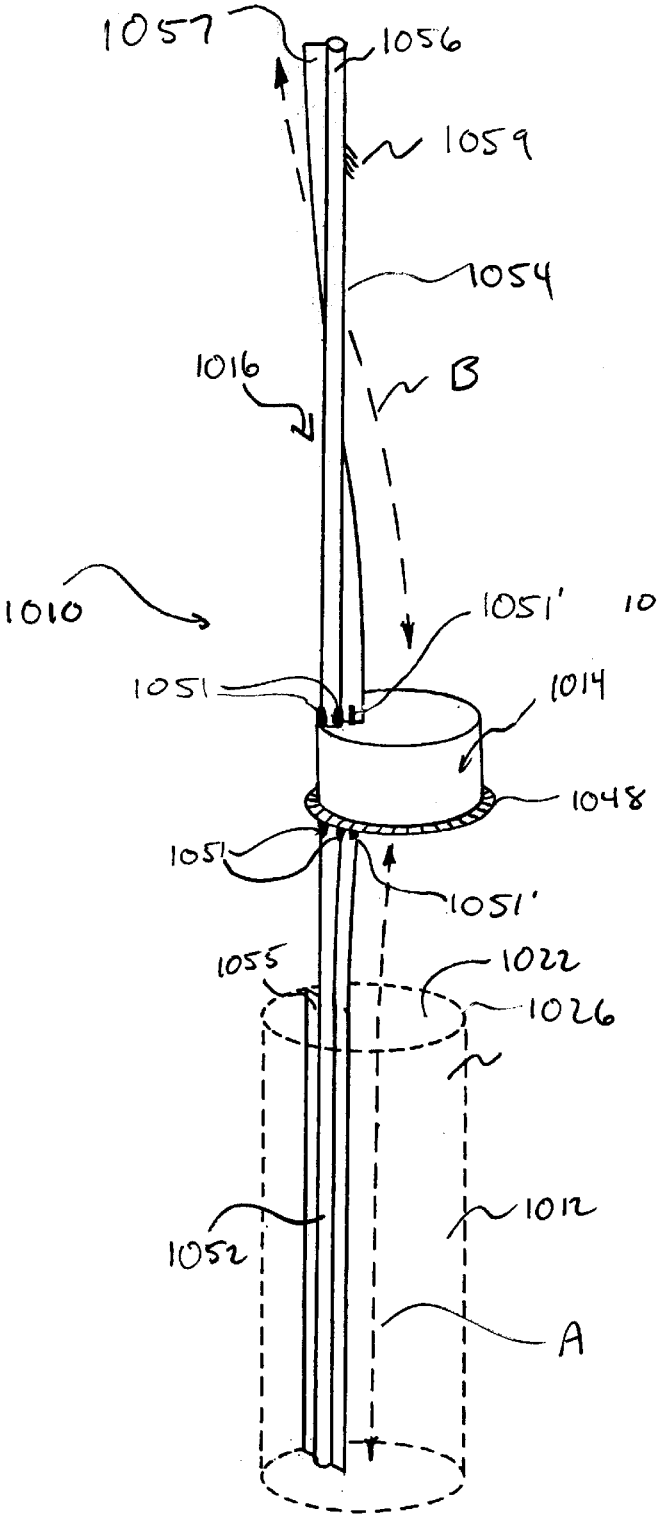
FIG. 13 is a perspective view of an amusement ride according to a tenth preferred embodiment of the present invention.
Figure 14:
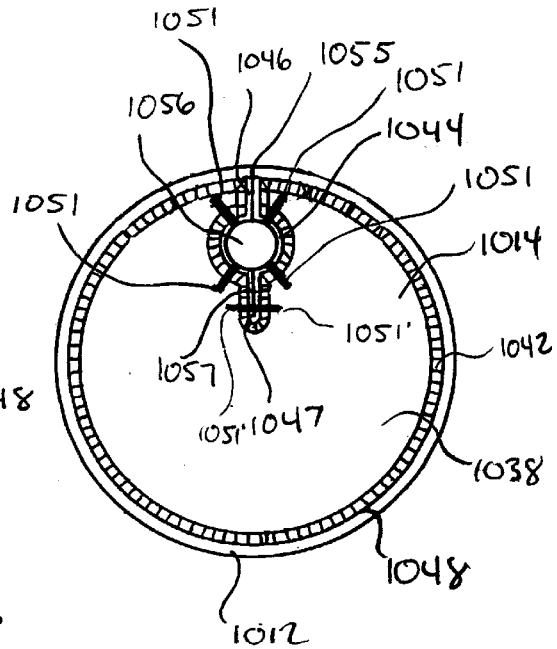
FIG. 14 is a cross-sectional view through the launch tube, looking upwardly at the pressure wall of the passenger vehicle, when the passenger vehicle is received inside the launch tube.

FIGS. 13 and 14 illustrate an amusement ride 1010 according to a tenth preferred embodiment of the invention. The amusement ride 1010 is similar to the amusement ride 10 shown in FIG. 1, with the major difference being that the track 1016 comprises a monorail 1056. In the preferred embodiment of FIGS. 13 and 14, both the launch/re-entry tube 1012 and the passenger vehicle 1014 are cylindrical, with the vehicle 1014 having a pressure wall 1038 (FIG. 14) at its lower end, the periphery of which is provided with sealing means 1048 of the same structure as described above with reference to the first preferred embodiment. The sealing means 1048 form a substantial seal with the inner surface 1022 of the launch tube 1012. The single rail 1056 comprising the track 1016 having an inner portion 1052 extending along, and in close proximity to, the inner surface 1022 of the launch tube 1012, and an outer portion 1054 extending outwardly of the open end 1026 of the launch tube 1012.

As illustrated in FIG. 13, the inner portion 1052 of the track 1016 is connected to and spaced from the inner surface 1022 of the launch tube 1012 by a support 1055 which, in the embodiment shown in the drawings, extends along the inner portion 1052 of track 1016. Furthermore, as shown in FIG. 13, the inner portion 1052 of track 1016 is straight and extends substantially vertically parallel to the launch tube 1012. The outer portion 1054 of track 1016 is also shown in FIG. 13 as being substantially straight and vertical, although this is not necessarily the case.

The monorail 1056 is preferably provided with a control rail 1057 extending along both the inner and outer portions 1052 and 1054 to control the spin of the vehicle 1014 as it travels along its path of travel. In this preferred embodiment, the control rail 1057 is shown as comprising a narrow web of material projecting outwardly from a surface of the monorail 1056, at about 180 degrees to the position of the support 1055. The portion of control rail 1057 extending along the inner portion 1052 of the monorail 1056 is preferably straight and at a constant angular spacing in relation to the support 1055, thus preventing spinning of the vehicle 1014 during launch and re-entry, which is undesirable. Therefore, during launch and re-entry, the vehicle 1014 travels along arrow A in a straight, vertical line until it exits the open end 1026 of launch tube 1012.

It will be seen from FIG. 13 that the portion of control rail 1057 extending along the outer portion 1054 of the monorail 1056 is twisted about the surface of the monorail, thus causing the vehicle 1014 to spin in a controlled manner as it travels through its intended path outside of the tube 1012, as illustrated by FIG. 13. Preferably, the outer portion 1054 of the monorail 1056 is supported by a support structure, schematically indicated by 1059.

FIG. 14 is an upwardly facing end view of the vehicle 1014 positioned inside launch tube 1012, showing the pressure wall 1038 of vehicle 1014 being provided at its periphery 1042 with resilient sealing means 1048 which form a substantial seal with the launch tube 1012. As illustrated, the pressure wall 1038 is provided with a circular aperture 1044 sized to receive the monorail 1056. The aperture 1044 communicates with the periphery 1042 of pressure wall through a channel 1046 which is adapted to receive the support 1055. Opposite channel 1046, the aperture 1044 additionally communicates with a channel 1047 which is adapted to receive the control rail 1057. The resilient sealing means 1048 are provided along the edges of the aperture 1044 and channels 1046 and 1047, thereby forming a substantial seal with the monorail 1056, support 1055 and control rail 1057.

As shown in FIGS. 13 and 14, the vehicle 1014 is provided with a set of four main rollers 1051 adjacent the upper guide point and a set of four main rollers 1051 adjacent the lower guide point. These rollers 1051 provide engagement between the vehicle 1014 and the monorail. In addition, the upper and lower guide points of vehicle 1014 are provided with control rollers 1051' which engage both sides of the control rail 1057, thus controlling spin of the vehicle 1014.

EXAMPLE

The following is a sample specification of a launch and re-entry tower ride having a simple opening/closing valve communicating with the source of pressurized air. The ride has the dimensions set out below, with all pressures being expressed relative to atmospheric pressure.

ride cycle time: 45 seconds
weight of passenger vehicle: 6000 kg (capacity of about 16 riders)
tube/pressure wall diameter: 3.5 m
tube height: 32 m
tube volume: about 310 $m^3$
connecting duct volume: 200 $m^3$
valve diameter: 1.5 m
tank charged air pressure: 30 kPa (valve closed)
tank and duct equalized air pressure: 25 kPa (valve just open)
tank discharged air pressure: 0 kPa (vehicle just exits the tube)
vehicle acceleration at start of launch: 30 $m/s^2$ (approximately 3 g, but riders experience 4 g)
vehicle acceleration as it exits tube: 0 $m/s^2$
thrust force on vehicle at start of launch: 240 kN
launch duration: 2 seconds (approx.)
maximum height reached by vehicle above tube exit: 45 m (approx.)
weightlessness time: 6 seconds (approx.)
vehicle re-entry terminal velocity in tube:<2 m/s (vehicle sinks in tube due to air weeping past the gap)
blower flow rate: 500 $m^3$/min
blower power: 250 kW (assuming 40% overall system efficiency)

Although the invention has been described in connection with certain preferred embodiments, it is not intended to be limited thereto. Rather, the invention includes all embodiments which may fall within the scope of the following claims.

What is claimed is:

1. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first open end of the launch tube; and wherein said pre-determined path along which said track means extends comprises a continuous loop in which the passenger vehicle is launched from the first end of the tube and is guided toward the second end of the tube, and wherein the second end of the tube includes a door to permit the passenger vehicle to enter the launch tube through its second end.

2. The amusement ride of claim 1, wherein the door comprises a membrane which is movable in a direction perpendicular to the tube to thereby open and close the second end of the tube.

3. The amusement ride of claim 1, wherein passenger vehicle braking means are provided along said track means proximate the second end of the launch tube.

4. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first open end of the launch tube; and wherein said track means comprises a guide tube having a cross-sectional area less than that of the launch tube, said guide tube extending along the inner surface of the launch tube.

5. The amusement ride of claim 4, wherein the outer portion of the track means has a raised portion elevated above the first end of the tube, and wherein the passenger vehicle reaches a point of maximum elevation on said raised portion of the track means.

6. The amusement ride of claim 5, wherein, at said point of maximum elevation, the raised portion of the track means is inclined relative to a horizontal plane so as to guide the passenger vehicle back into the first end of the tube along said track means.

7. The amusement ride of claim 5, wherein the outer portion of the track means is provided with an emergency braking section, and wherein the point of maximum elevation is located between the first end of the tube and the emergency braking section.

8. The amusement ride of claim 4, further comprising a brake tube at which said predetermined path terminates, said brake tube having first and second ends and a cross-sectional shape and size substantially the same as that of the launch tube so that a substantially sealed space is formed between the passenger vehicle and the second end of the brake tube, the first end of the brake tube being open to permit said track means to extend into said brake tube through said first end, the second end of the brake tube being sealed so as to permit braking of said passenger vehicle by pressurization of air in the substantially sealed space.

9. The amusement ride of claim 8, additionally comprising means for storing the pressurized gas generated during braking of the passenger vehicle in the brake tube.

10. The amusement ride of claim 8, wherein the brake tube is horizontally displaced from the launch tube.

11. The amusement ride of claim 8, wherein the substantially sealed space of the brake tube communicates with a pressurized gas source for introducing pressurized gas into the substantially sealed space of the brake tube, sufficient to launch the passenger vehicle along the guidance means and out of the brake tube.

12. The amusement ride of claim 4, wherein the guide tube and the launch tube are each attached to a support wall such that said passenger vehicle comprises a portion of an annulus.

13. The amusement ride of claim 4, additionally comprising auxiliary propulsion means to propel the passenger vehicle along its pre-determined path.

14. The amusement ride of claim 4, additionally comprising a control exhaust valve to relieve pressure in the tube during re-entry of the passenger vehicle.

15. The amusement ride of claim 4, additionally comprising one or more position sensors to monitor the position of the passenger vehicle at least one point along the pre-determined path.

16. The amusement ride of claim 4, wherein the guide tube is provided with a control rail along its outer surface to control the orientation of the vehicle relative to the guide tube.

17. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first open end of the launch tube; and wherein the outer portion of the track means is supported by a substantially vertically extending support tower, the track means extending along an outer surface of the support tower.

18. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein said guidance means comprises a rigid track means extending along the predetermined path from the first end of the tube, said ride further comprising a plug member extending parallel to said launch tube such that an annular space of constant cross-section is formed between the plug member and the tube, and wherein the passenger vehicle comprises an annular body adapted to be received in said annular space.

19. The amusement ride of claim 18, wherein the track means extend to a point which is elevated above the first end of the launch tube and a top of the plug member.

20. The amusement ride of claim 19, wherein the track means comprises a guide tube of substantially the same cross-sectional area and shape as the launch tube, the guide tube being provided with a plurality of perforations.

21. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first open end of the launch tube;

wherein the passenger vehicle is provided with at least one pressure wall against which a launching force generated by said pressurized gas is exerted, with said substantial seal between the passenger vehicle and the inner surface of the launch tube being formed by an outer periphery of the pressure wall; and wherein said pressure wall is provided with at least one aperture located inwardly of its outer periphery, said aperture communicating with the outer periphery of the pressure wall, the track means being received in said at least one aperture.

22. The amusement ride of claim 21, wherein the track means comprises at least two rails which are arranged in parallel spaced relation to one another.

23. The amusement ride of claim 22, wherein the rails are twisted about said predetermined path so as to produce controlled rotation of said passenger vehicle about said predetermined path.

24. The amusement ride of claim 21, wherein resilient sealing means are provided along the outer periphery and said at least one aperture of the pressure wall.

25. The amusement ride of claim 24, additionally comprising at least one utility device extending parallel to at least a portion of said track means, said utility device comprising an elongate rail member, wherein the pressure wall is provided with a utility device aperture located inwardly of its outer periphery, said utility device aperture communicating with the outer periphery of the pressure wall and provided with said resilient sealing means to form a substantial seal with the rail member of the utility device.

26. The amusement ride of claim 21, wherein the passenger vehicle is provided with two of said pressure walls, a first pressure wall proximate a front end of the passenger vehicle, and a second pressure wall proximate a rear end of the passenger vehicle.

27. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first open end of the launch tube;

wherein the passenger vehicle is provided with at least one pressure wall against which a launching force generated by said pressurized gas is exerted, with said substantial seal between the passenger vehicle and the inner surface of the launch tube being formed by an outer periphery of the pressure wall; and wherein the passenger vehicle comprises a pressure wall stage and a passenger vehicle stage which are releasably connected to one another, the amusement ride additionally comprising pressure wall stage braking means located proximate the first end of the tube to cause separation of the pressure wall stage and the passenger vehicle stage during launch of the passenger vehicle.

28. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path;

a pressurized gas source for introducing pressurized gas into the substantially sealed space inside said launch tube sufficient to launch the passenger vehicle along said guidance means and out of the launch tube; and one or both of stop means and releasable latch means located proximate the second end of the tube, the stop means positioning the passenger vehicle at its home position, and the latch means retaining the vehicle in its home position.

29. An amusement ride, comprising:

a hollow launch tube having an inner surface, and first and second ends, the first end being open;

a passenger vehicle having an outer peripheral surface which forms a substantial seal with the inner surface of the launch tube so as to form a substantially sealed space inside said launch tube from said passenger vehicle to the second end of the launch tube;

guidance means for guiding said passenger vehicle along a pre-determined path to exit the launch tube, said guidance means being self-rigid and extending through said open first end along said pre-determined path; and a pressurized gas source for introducing pressurized gas into the substantially sealed space inside said launch tube sufficient to launch the passenger vehicle along said guidance means and out of the launch tube;

wherein said launch tube is provided with a passenger vehicle exchange opening of sufficient size to allow the passenger vehicle to be removed or inserted into the launch tube, said passenger vehicle exchange opening being provided with a door adapted to seal said passenger vehicle exchange opening, said amusement ride further comprising means for removing and inserting said passenger vehicle from said launch tube.

30. The amusement ride of claim 29, wherein the passenger vehicle exchange opening is provided in the side wall of the launch tube.

31. The amusement ride of claim 29, wherein said launch tube is provided with at least one passenger exchange opening provided with a door adapted to seal said passenger exchange opening.

32. An amusement ride, comprising:

a hollow launch tube having an inner surface, and first and second ends, and at least one door;

a passenger vehicle having an outer peripheral surface which forms a substantial seal with the inner surface of the launch tube so as to form a substantially sealed space inside said launch tube from said passenger vehicle to one said door with said door in a closed position;

guidance means for guiding said passenger vehicle along a pre-determined path to exit the launch tube, said guidance means being self-rigid and extending through said first and second ends along said pre-determined path; and a pressurized gas source for introducing pressurized gas into the substantially sealed space inside said launch tube sufficient to launch the passenger vehicle along said guidance means and out of the launch tube;

wherein the guidance means comprises rigid track means extending along said pre-determined path, the track means having an inner portion extending along, and in close proximity to, the inner surface of the launch tube, and an outer portion extending outwardly of the first and second ends of the launch tube; and wherein said pre-determined path along which said track means extends through said tube, and wherein the vehicle is launched from the first end of the tube, re-enters the first end of the tube and is then launched from the second end of the tube in the opposite direction, the vehicle subsequently re-entering the second end of the tube.

* * * * *

UNITED STATES PATENT AND TRADEMARK OFFICE

CERTIFICATE OF CORRECTION

PATENT NO. : 6,397,755 B1
DATED : June 4, 2002
INVENTOR(S) : Hitomi Sano et al.

It is certified that error appears in the above-identified patent and that said Letters Patent is hereby corrected as shown below:

Column 1,
Line 61, “junction” should read -- junctions --.

Column 3,
Lines 24 and 56, “of;” should read -- of: --.

Column 4,
Line 24, “of;” should read -- of: --.

Column 12,
Line 5, “any dielectric material is not” should read -- no dielectric material is --.

Column 19,
Line 50, “less causes the” should read -- to a lesser extent cause --.

Column 20,
Line 29, “made less occur” should read -- be suppressed --.

Column 24,
Lines 19 and 40, “comprise” should read -- comprises --.

Signed and Sealed this

Third Day of December, 2002

JAMES E. ROGAN
*Director of the United States Patent and Trademark Office*